US005956294A

United States Patent [19]

Takizawa et al.

[11] Patent Number: 5,956,294

[45] Date of Patent: Sep. 21, 1999

[54] MULTI-FUNCTIONAL TIMEPIECE

[75] Inventors: Katsuyoshi Takizawa; Norio Shibuya; Takashi Takahashi, all of Chiba, Japan

[73] Assignee: Seiko Instruments Inc., Japan

[21] Appl. No.: 08/987,731

[22] Filed: Dec. 9, 1997

[30] Foreign Application Priority Data

Dec. 26, 1996 [JP] Japan ..... 8-348687

[51] Int. Cl.[6] ..... G04B 19/20

[52] U.S. Cl. ..... 368/37; 368/35

[58] Field of Search ..... 368/28–38, 322, 368/323

[56] References Cited

U.S. PATENT DOCUMENTS 2,056,089 9/1936 Boggs ..... 368/37

3,721,083 3/1973 Jauch ..... 368/18

3,911,667 10/1975 Komiyama ..... 368/38

4,271,493 6/1981 Tamaru et al. ..... 368/28

*Primary Examiner*—Bernard Roskoski

*Attorney, Agent, or Firm*—Adams & Wilks

[57] ABSTRACT

A multi-functional timepiece comprises a base, a wheel train mounted on the base for rotation, a cam member rotationally driven by the wheel train about a rotational center, and a rotary member mounted to undergo angular displacement in opposite directions. A display member is integrally connected to the rotary member for angular displacement therewith to display time or date information. An interconnecting member interconnects the cam member to the rotary member such that rotational motion of the cam member effects angular displacement of the rotary member in the opposite directions.

38 Claims, 25 Drawing Sheets

MULTI-FUNCTIONAL TIMEPIECE

BACKGROUND OF THE INVENTION

1. Field of the Invention

The present invention generally relates to a multi-functional timepiece, particularly, the present invention can provide a multi-functional timepiece having at least one of various additional portions of a calendar display portion of date display and day display, a time display portion and a time correcting portion in a 24 hour system and the like and having a calendar display structure including a novel and easy-to-see display portion, can provide a multi-functional timepiece having an easy-to-use time correction structure and can realize a multi-functional timepiece having a novel and easy-to-see dual time display portion.

2. Description of the Prior Art

In the structure of a timepiece, particularly a wrist watch having many functions, a movement (mechanical body) of a timepiece is generally provided with a main plate constituting a base plate of the movement.

Further, one side in both sides of the main plate having a dial is referred to as reverse side of timepiece and a side of both sides of the main plate opposed to the dial is referred to as obverse side of timepiece. Further, a wheel train integrated to the obverse side of timepiece is referred to as obverse wheel train and a wheel train integrated to the reverse side of timepiece is referred to as reverse wheel train.

Further, numerals of 1 through 12 are often described at an outer peripheral portion of a dial of a timepiece and accordingly, respective directions along the outer peripheral portion of a timepiece are expressed by using the numerals. For example, in the case of a wrist watch, the upper direction and the upper side of the wrist watch is referred to respectively as "12 o'clock direction" and "12 o'clock side", the right direction and the right side of the wrist watch are respectively referred to as "3 o'clock direction" and "3 o'clock side", the lower direction and the lower side of the wrist watch are respectively referred to as "6 o'clock direction" and "6 o'clock side" and the left direction and the left side of the wrist watch are respectively referred to as "9 o'clock direction" and "9 o'clock side".

Generally, according to a wrist watch, a driving portion, a control portion, an obverse wheel train and the like are integrated to the obverse side of the watch. Meanwhile, calendar portions, for example, a date driving portion, a date wheel, a date correction portion, a day driving portion, a day wheel, a day correction portion and the like are integrated to the reverse side of the watch. Further, according to a wrist watch, a switch portion may be integrated to the obverse side of the watch, may be integrated to the reverse side of the watch, or may be integrated to both of the obverse side and the reverse side of the watch.

According to a conventional multi-functional timepiece, for example, a wrist watch having date display and day display, a day wheel is provided with a shape of a circular ring and provided with 31 teeth. Numerals of 1 through 31 are printed on the date wheel. The date wheel is integrated rotatably along the outer periphery of the main plate.

Further, the day wheel is provided with the shape of a circular disk and is provided with 7 or 14 teeth. Letters of 7 days of week of Sunday, Monday, Tuesday and so on are printed on the day wheel. The day wheel is integrated rotatably to an inner side of the date wheel.

The date wheel is driven by 1 tooth per day by rotation of a date driving wheel. The day wheel is driven by 1 tooth per day by rotation of a day driving wheel. One numeral of the date wheel, for example, "1" and one letter of the day wheel, for example, "Monday" can be seen from windows of the dial. Accordingly, a wrist watch user can know that today is 1st. day and Monday by the date display and the day display.

Further, the date display and the day display are normally arranged on the 3 o'clock side or 6 o'clock side of the watch.

Further, according to a wrist watch displaying date and day by hands, for example, a rotational center of the date wheel is disposed on the 3 o'clock side of the watch at a substantially intermediate position between the rotational center of the hour wheel and the outer peripheral portion of the main plate, that is, at a substantially intermediate point of the radius of the main plate. Similarly, the rotational center of the day wheel is disposed on the 9 o'clock side of the watch at a substantially intermediate position between the rotational center of the hour wheel and the outer peripheral portion of the main plate, that is, at a substantially intermediate point of the radius of the main plate. Date is displayed by a date hand attached to the date wheel. Day of week is displayed by a day hand attached to the day wheel.

Further, conventionally, when two gears were integrated by adjusting phases thereof, an assembly operator integrates the two gears by sensitively recognizing the phases of the two gears.

Further, according to a conventional structure displaying a fan shape hand, an independent motor is provided for the hand separately from a motor for normal time display.

Further, according to such a conventional wrist watch having a calendar, a winding stem is set to three positions of "0-th stage", "1-th stage" and "2-the stage".

In this case, the "0-th stage" of the winding stem is in a "normal carry state" where the winding stem is pushed to a case of the wrist watch. In this state, a power spring can be wound in a mechanical watch.

In this case, the "1-th stage" of the winding stem is in a "first correctable state" where the winding stem is drawn from the case of the wrist watch by 1 stage. In this state, date display and day display can be corrected in the wrist watch having a calendar.

In this case, the "2-th stage" of the winding stem is in a "second correctable state" where the winding stem is drawn further. In this state, correction of time display can be performed in the wrist watch having a calendar.

Further, according to a conventional wrist watch having a time correcting portion, the hour wheel is provided with an hour wheel gear and a hour jumper pinion. The hour jumper pinion is provided with 12 teeth. The hour wheel is integrated to the outer peripheral portion of a cannon pinion. An hour hand showing time is integrated to the hour jumper pinion. A hammer for performing operation of time difference correction is integrated to a pin fixed to the main plate.

When a user performs operation of time difference correction, the time correction winding stem is drawn to the 1-th stage. By driving the hour jumper pinion by 1 tooth by rotating the time correction winding stem, display of hour hand can be changed by a unit of 1 hour.

Further, according to a conventional analog watch of dual time display, normally, two movements of watch are arranged in the watch. Further, the two movements of watch are constituted to operate independently from each other.

That is, a first movement is provided with first ones of a hour hand, a minute hand and the like and these hands display a first time. The first movement is provided with a first winding stem and by operating the first winding stem, time display of the first movement can be corrected.

Meanwhile, a second movement is provided with second ones of a hour hand, a minute hand or the like and these hands display a second time. The second movement is provided with a second winding stem and by operating the second winding stem, time display of the second movement can be corrected.

Accordingly, in the conventional analog watch of dual time display, the first time is displayed by operating the first movement and the second time is displayed by operating the second movement. For example, a user adjusts the first time to time at the actual place (local time) and adjusts the second time to time of mother country (home time).

Further, according to such a conventional watch, a center hole of the hour wheel is guided by the outer peripheral portion of the cannon pinion.

Further, according to such a conventional watch, two gears having the same rotational center are integrally constituted by strikingly fixing a hole portion of one gear to a cylindrical portion provided to other gear.

However, there are following problems in the conventional multi-functional timepiece.

(1) According to the structure where the date wheel and the day wheel are arranged substantially in a total of the main plate on the dial side, it is difficult to mount other function to the wrist watch.

(2) According to the structure where date and day are displayed respectively by the date hand and the day hand, it is difficult to provide the date hand and the day hand at vicinities of the outer peripheral portion of the dial. Further, according to the structure where a plurality of motors are used, a number of parts is increased and the watch is enlarged.

(3) In the case of the watch having a time correcting portion, when the time correction winding stem is drawn to the 1-th stage, the display remains unchanged and therefore, the wrist watch user cannot determine whether operation of time difference correction can be performed. Further, when time correction is performed in the reverse direction, operation of the operating cam and the hammer may become unstable whereby operation of time correction may become unpreferable.

(4) According to the conventional analog watch of dual time display, the two movements are provided and therefore, the structure is complicated and the size of the movements is large. Further, it is difficult to read current time since the respective displays are small.

(5) According to the structure where the hour wheel is guided by the outer peripheral portion of the cannon pinion, a part for guiding the hour wheel performs rotational motion and the hour wheel may be made to be synchronized with the rotational motion. Therefore, the motion of the hour hand attached to the hour wheel may become unnatural. Further, in performing time correction, the operation of a second hand may not be stabilized due to impact received by the hour wheel.

(6) In integrating the date driving wheel and the day wheel, it is difficult to integrate them by adjusting the phases of the respective wheels.

(7) A pin is needed in the dial for integrating a small hour corrector lever.

(8) In manufacturing intermediate gears and the like used in the multi-functional timepiece, it is difficult to fix two gears by adjusting phases thereof. Further, a special tool is needed for fixing the two gears.

SUMMARY OF THE INVENTION (1) It is an object of the present invention to provide a multi-functional timepiece having novel outlook and shape in order to resolve the conventional problems.

(2) It is other object of the present invention to provide a display device displaying information by a hand rotating within a range of a constant angle.

(3) It is other object of the present invention to provide a timepiece having a time correcting portion capable of performing stable operation of time difference correction.

(4) It is other object of the present invention to provide a timepiece having a time correcting portion where motion of hand is stabilized.

(5) It is other object of the present invention to provide a timepiece having a time correcting portion displaying a state where operation of time difference correction can be performed and a state where operation of time difference correction cannot be performed.

(6) It is other object of the present invention to provide a timepiece whereby integration of a date driving wheel and a day wheel while adjusting phases thereof is facilitated.

(7) It is other object of the present invention to provide a timepiece having a time correcting portion capable of guiding a small hour hand corrector lever without using a pin fixed to a main plate.

(8) It is other object of the present invention to provide an analog watch having a dual time display portion that is easy to see and easy to use.

(9) It is other object of the present invention to provide gears in which two gears can be fixed easily while adjusting phases thereof and a timepiece integrated with the gears.

In order to resolve the above-described problems, according to the present invention, there is provided a multi-functional timepiece including a driving portion for driving the multi-functional timepiece, a control portion for controlling operation of the driving portion, a wheel train portion rotating based on operation of the driving portion, an operating cam having a cam peripheral part, a radius extending from a rotational center to an outer peripheral face of which is formed to change continuously in a circumferential direction with a value between a minimum value and a maximum value and rotating based on rotation of the wheel train portion, a hammer oscillating by being brought into contact with the outer peripheral face of the operating cam, a small gear wheel rotating based on oscillating motion of the hammer and a day hand displaying information of time, calendar or the like based on rotation of the small gear wheel wherein the operating cam is rotated based on the rotation of the wheel train portion in a direction of substantially increasing a distance between the rotational center and a point where the operating cam is brought into contact with the hammer.

In this case, by rotation of the small gear wheel, for example, day of week in calendar can be displayed. In this case, the small gear wheel is a small day wheel.

According to the constitution having the small day wheel, the day hand is rotated in a range of a predetermined angle. That is, the day wheel is moved in a range having a fan shape. Seven days of week are displayed by the day hand.

Further, according to the multi-functional timepiece of the present invention, it preferably includes an intermediate day wheel driving gear integrally formed with the operating cam, an intermediate gear jumper for regulating rotation of the intermediate day wheel driving gear and a wheel train portion for intermittently rotating the intermediate day wheel driving gear.

By such a constitution, the intermediate day wheel driving gear is positioned always at the predetermined location. Therefore, according to the constitution having the day hand, the day hand firmly indicates one of letters on the dial showing days of week. Further, letters showing days of week can be enlarged by the constitution.

Further, according to the multi-functional timepiece of the present invention, it is preferable that a spring member for providing a rotational force in a direction of pressing the hammer to the operating cam is provided at the small gear wheel.

By such a constitution, according to the constitution having the day hand, the day hand firmly indicates one of letters on the dial showing days of week.

Further, it is preferable that the multi-functional timepiece of the present invention further includes a day indicator driving wheel rotating based on the operation of the driving portion, a date driving wheel rotating based on the operation of the driving portion, day indicator driving wheel phase adjustment means provided at the day indicator driving wheel for adjusting phases of a day indicator driving wheel gear of the day indicator driving wheel and a date driving wheel gear of the date driving wheel, and date driving wheel phase adjustment means provided at the date driving wheel for adjusting the phases of the day indicator driving wheel gear of the day indicator driving wheel and the date driving wheel gear of the date driving wheel.

By such a constitution, the day indicator driving wheel and the date driving wheel can be integrated to firmly perform display of date and day.

Further, it is preferable that the multi-functional timepiece of the present invention is constituted such that a difference between an angle made by a line connecting a position of a portion of the day indicator driving wheel phase adjustment means and a rotational center of the day indicator driving wheel and a line connecting a portion of a day finger and the rotational center of the day indicator driving wheel and an angle made by a line connecting a position of a portion of the date driving wheel phase adjustment means and a rotational center of the date driving wheel and a line connecting a portion of a date finger and the rotational center of the date driving wheel, is 45° or less.

According to such a constitution, a difference of time between date driving start time and day driving start time is reduced and the driving operation can be finished swiftly.

Further, it is preferable that the multi-functional timepiece of the present invention further includes an hour wheel gear rotating based on the operation of the driving portion, an hour jumper pinion integrated to the hour wheel gear such that a phase of rotation thereof with respect to a phase of the hour wheel gear can be changed and rotating integrally with the hour wheel gear, an hour hand displaying time information based on rotation of the hour jumper pinion, a time correction transmitting portion for rotating the hour jumper pinion, a small hour hand corrector lever disengaging the hammer from the operating cam in performing the operation of the time correction, and a day hand displaying that the timepiece is set to a time correction state by the small gear wheel rotating based on the oscillating motion of the hammer.

According to the constitution, the hand can clearly display that-time is set to the time correction state.

Further, it is preferable that the multi-functional timepiece of the present invention further includes a small hour corrector winding stem for performing operation of time correction, a small hour hand corrector setting lever oscillating based on movement of the small hour corrector winding stem in an axial line direction, a small hour hand corrector lever for disengaging the hammer from the operating cam based on operation of the small hour hand corrector setting lever, a small hour hand corrector clutch wheel moving in the axial line direction of the small hour corrector winding stem based on operation of the small hour hand corrector setting lever and rotating based on rotation of the small hour corrector winding stem, and a time correction transmitting wheel train portion for rotating the hour jumper pinion based on rotation of the small hour hand corrector clutch wheel.

Here, according to the constitution having day display, the time correcting portion includes the day indicator driving wheel. According to the constitution having no day display, the time correcting portion includes the time correction transmitting gear.

According to the constitution, a time correction structure operating firmly can be manufactured.

Further, it is preferable that the small hour hand corrector lever of the multi-functional timepiece of the present invention is provided with a long hole integrated to a stem portion of a gear member constituting a time correction wheel train.

According to the constitution, a time correction structure using a small number of parts and yet operating firmly can be manufactured.

Further, it is preferable that the multi-functional timepiece of the present invention further includes a small hour hand wheel constituted to rotate based on rotation of the hour wheel at a rotational speed that is a half of a rotational speed of the hour wheel and a 24 hour hand for displaying time in a 24 hour system.

According to the constitution, a timepiece simultaneously displaying time in a 12 hour system and a 24 hour system can be manufactured. Further, according to the multi-functional timepiece of the present invention having a time correcting portion, a hand of the 12 hour system can display a first time and at the same time a hand of the 24 hour system can display a second time. Accordingly, a dual time watch simultaneously displaying a local time and a home time can be realized by the constitution of the present invention.

Further, a wheel train member for display of the timepiece according to the present invention, includes an hour wheel formed with a plurality of band portions at an outer periphery thereof, a bush for hour wheel rotatably supporting the band portions of the hour wheel and a center wheel and pinion rotating without being brought into contact with the center hole of the hour wheel.

According to the constitution, a support structure of the hour wheel using a small number of parts and yet operating firmly can be manufactured. Further, operation of respective hands are much stabilized.

Further, a wheel train member for transmitting rotation according to the present invention, includes a first gear having a guide pin and integrated rotatably to the timepiece and a second gear, a portion of a bottom of which is guided by the guide pin and integrated to the timepiece to rotate with a rotational center the same as the rotational center of the first gear.

According to such a constitution, the wheel train structure using a small number of parts and yet firmly moving cooperatingly can be manufactured. Further, operation of respective hands is much stabilized.

It is preferable that the multi-functional timepiece of the present invention includes the above-described wheel train member for display and/or the above-described wheel train member for transmitting rotation.

According to such a constitution, the multi-functional timepiece having the wheel trains each using a small number of parts and yet operating firmly can be manufactured.

DETAILED DESCRIPTION OF THE PREFERRED EMBODIMENTS

An explanation will be given of embodiments of the present invention in reference to the drawings as follows.

(1) Structure of Calendar Portion

Now, an explanation will be given of embodiments of a multi-functional timepiece according to the present invention. Although in this specification, an explanation will be given of embodiments of a multi-functional timepiece of the present invention with regard to a mechanical watch, the constitution of the multi-functional timepiece of the present invention is applicable also to timepieces having other principle of operation of an electronic watch, an electric watch or the like.

Figure 1:
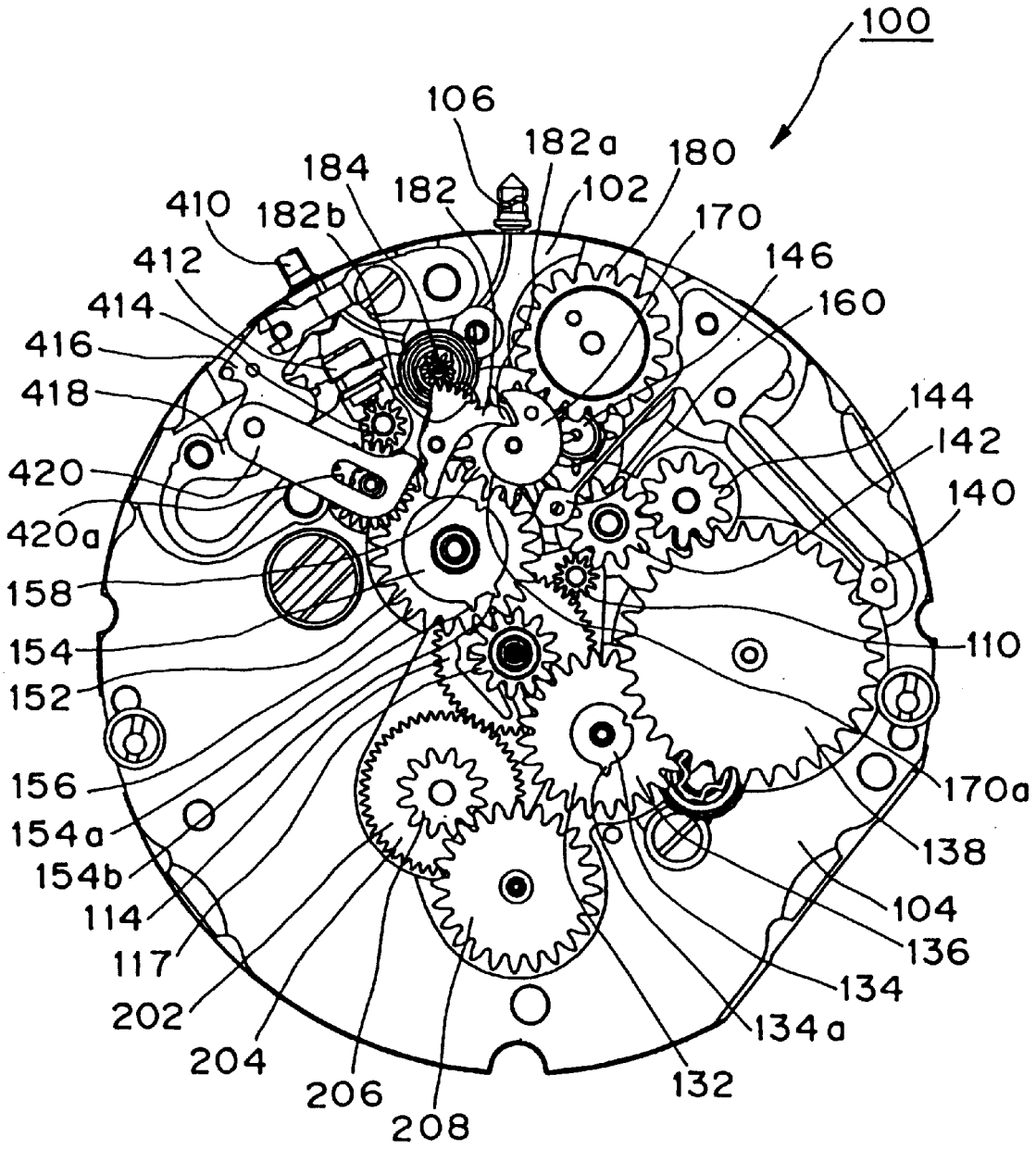
FIG. 1 is an outline plane view showing a calendar portion and a time correcting portion according to an embodiment of a multi-functional timepiece of the present invention in a state where an auxiliary train wheel bridge is removed.
Figure 2:
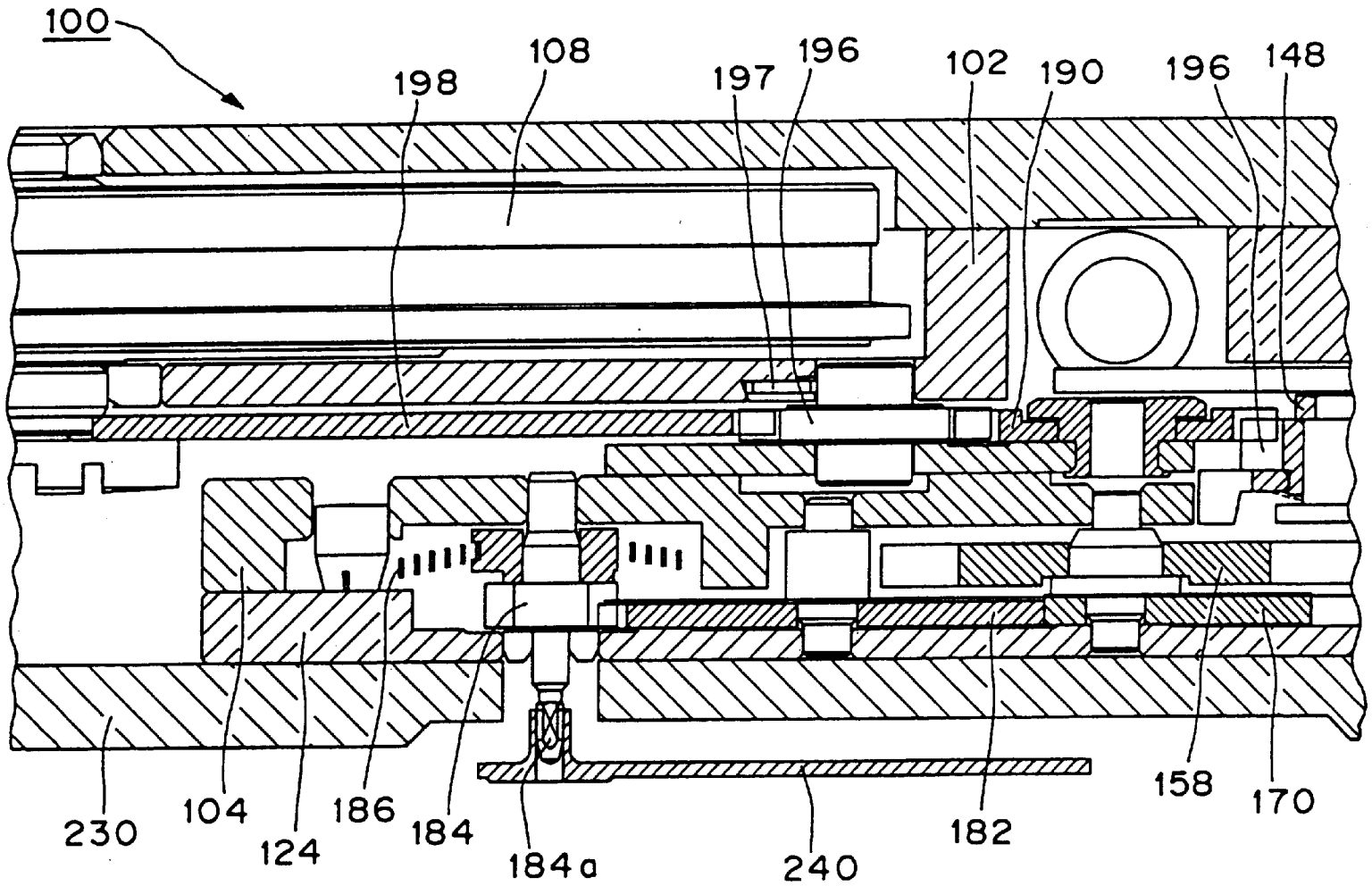
FIG. 2 is a partial sectional view showing a first portion of the calendar portion according to an embodiment of a multi-functional timepiece of the present invention.
Figure 3:
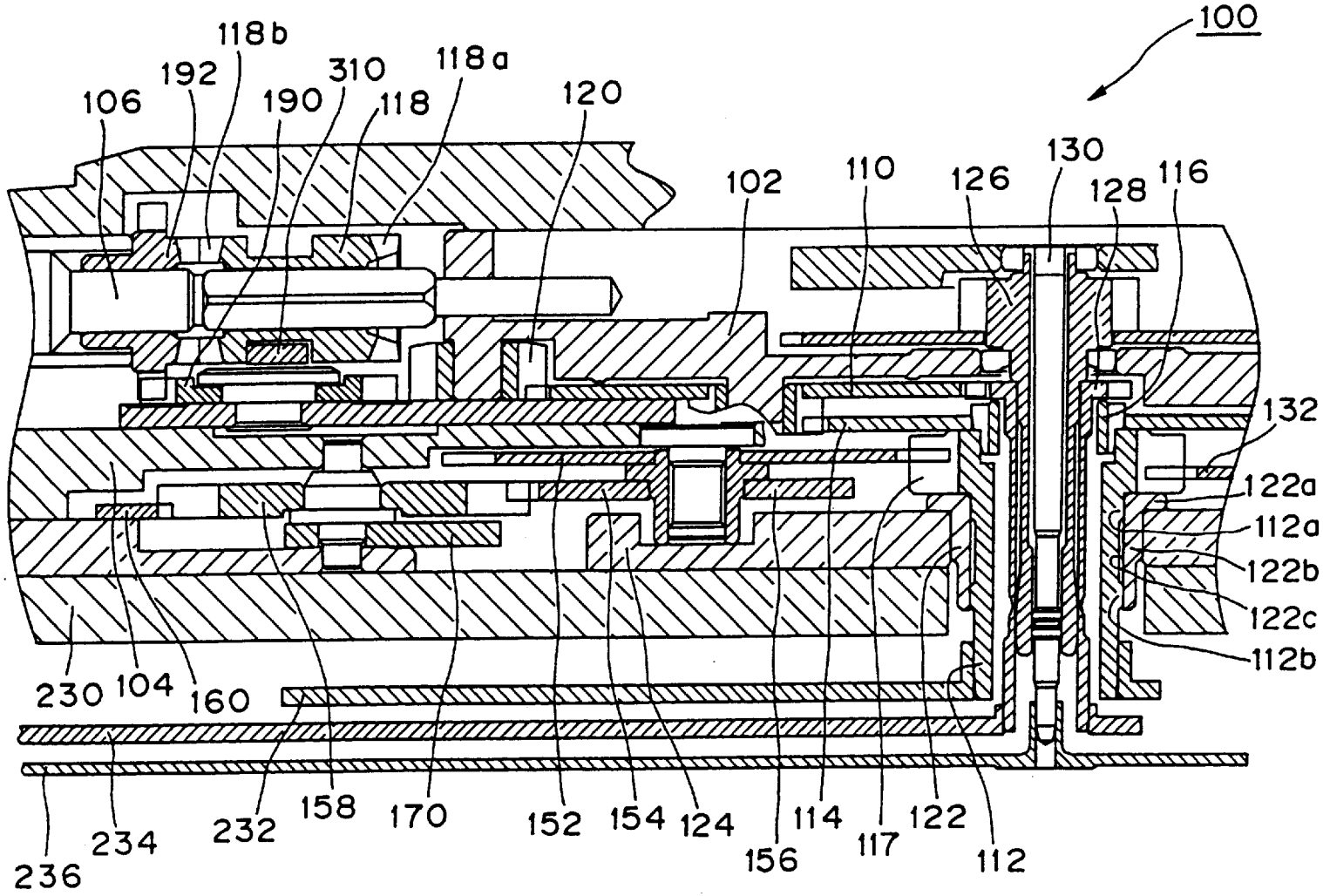
FIG. 3 is a partial sectional view showing a second portion of the calendar portion according to the embodiment of the multi-functional timepiece of the present invention.

Referring to FIG. 1 through FIG. 3, a movement (mechanical body) 100 of the multi-functional timepiece of the present invention includes a main plate 102 and an auxiliary plate 104. A winding stem 106 is integrated to the main plate 102. The winding stem 106 is integrated to the 3 o'clock direction of the timepiece.

A complete barrel with main spring 108 constitutes a portion of the obverse wheel train. A minute wheel and pinion 110 is integrated to rotate by rotation of the obverse wheel train. An hour wheel 112 is provided with an hour wheel gear 114, an hour jumper pinion 116 and an intermediate date driving wheel and pinion 117. The rotational center of the hour wheel 112 is disposed at a portion of the main plate 102 substantially proximate to the center.

The hour jumper pinion 116 and the intermediate date driving wheel and pinion 117 are constituted to rotate integrally with the hour wheel gear 114. The hour jumper pinion 116 is constituted to be able to position by rotating by a unit of 30° in the outer peripheral direction with respect to the hour wheel gear 114. A clutch wheel 118 is integrated to the winding stem 106. A setting wheel 120 is integrated to the main plate 102. A reverse gear of the minute wheel and pinion 110 is in mesh with the setting wheel 120.

A bush for hour wheel 122 is fixed to an auxiliary train wheel bridge 124. The bush for hour wheel 122 is provided with a flange portion 122*a* and a cylindrical portion 122*b*. The bush for hour wheel 122 may be formed integrally with the auxiliary train wheel bridge 124.

The hour wheel 112 is provided with two band portions 112*a* and 112*b* at an outer periphery of a cylindrical portion thereof. The band portions 112*a* and 112*b* of the hour wheel 112 are integrated to a guide hole 122*c* of the bush for hour wheel 122. It is preferable that two of the band portions 112*a* and 112*b* of the hour wheel 112 are provided remote from each other. That is, the band portion 112*a* is brought into contact with a portion of the bush for hour wheel 122 proximate to the flange portion 122*a* and the band portion 112*b* is brought into contact with a portion of the bush for hour wheel 112 at a distal end of the cylindrical portion 122*b*. Three of the band portions of the hour wheel 112 may be provided remote from each other.

According to such a constitution, the hour wheel 112 is not guided by a rotating gear. Accordingly, operation of the hour wheel 112 is stabilized and display of time is very easy to see. This structure is especially advantageous in the case of a timepiece having a time correcting portion.

A center wheel and pinion 126 is provided with a cannon pinion 128. The outer peripheral portion of the cannon pinion 128 is integrated such that the outer peripheral portion is not brought into contact with a center hole of the hour wheel 112. A second wheel pinion 130 is integrated into a center hole of the center wheel and pinion 126.

A date driving wheel gear 132 is integrated to be in mesh with the intermediate date driving wheel and pinion 117. A date finger 134 is formed integrally with the date driving wheel gear 132. A date driving wheel 136 is constituted by the date driving wheel gear 132 and the date finger 134. The date finger 134 is provided with a date finger driving portion 134*a*. A date star 138 is integrated to be intermittently driven by the date finger 134. A date jumper 140 regulates rotation of the date star 138.

According to the embodiment, the rotational center of the date star 138 is in the 6 o'clock direction of the timepiece and is disposed at a portion of the main plate 102 proximate to a substantially intermediate point of the radius.

It is preferable that the rotational center of the date star 138 is disposed at a position of substantially 30% through 70% of the radius of the main plate 102 in the 6 o'clock direction of the timepiece. It is further preferable that the rotational center of the date star 138 is disposed at a position of substantially 40% through 60% of the radius of the main plate 102 in the 6 o'clock direction of the timepiece. It is still further preferable that the rotational center of the date star 138 is disposed at a portion proximate to a substantially middle point of the radius of the main plate 102 in the 6 o'clock direction of the timepiece.

According to the constitution, date display that is large and easy to see can be provided.

A first date correction transmitting wheel 142 and a second date correction transmitting wheel 144 are integrated between the auxiliary plate 104 and the auxiliary train wheel bridge 124. The first date correction transmitting wheel 142 is in mesh with the second date correction transmitting wheel 144. The second date correction transmitting wheel 144 is in mesh with the date star 138. A calendar correction wheel 146 is integrated to a calendar correction oscillating lever 148.

A day indicator driving wheel gear 152 is integrated to be in mesh with the intermediate date driving wheel and pinion 117. A day finger 154 is integrally formed with the day indicator driving wheel gear 152. The day finger 154 is provided with two day finger driving portions 154*a* and 154*b*. A day indicator driving wheel 156 is constituted by the day indicator driving wheel gear 152 and the day finger 154.

An intermediate day wheel driving gear 158 is integrated to be intermittently driven by the day finger 154. A day jumper 160 regulates rotation of the intermediate day wheel driving gear 158. The date jumper 140 and the day jumper 160 are constituted as one part.

An operating cam 170 is provided integrally with the intermediate day wheel driving gear 158. A cam peripheral part 170*a* of the operating cam 170 is formed such that a radius thereof extending from the rotational center to the outer peripheral face is changed in the circumferential direction.

In this case, the radius of the cam peripheral part 170*a* of the operating cam 170 is formed to smoothly increase from a minimum value RMIN to a maximum value RMAX thereof along the circumferential direction of the cam peripheral part 170*a*. Further, a stepped portion where the radius of the cam peripheral part 170*a* is abruptly changed is arranged between a portion having the maximum value RMAX and a portion having the minimum value RMIN. That is, the cam peripheral part 170*a* of the operating cam 170 is provided with a contour shape which is widened uniformly in a vortex shape from the minimum radius portion that is mostly proximate to the rotational center of the operating cam 170 to the maximum radius portion of the operating cam 170 and in which the portion having the maximum value RMAX of the cam peripheral part 170*a* is continuously connected to the portion having the minimum value RMIN.

As a result, the cam peripheral part 170*a* of the operating cam 170 is provided with a shape similar to a cam face of a so-called "oscillating cam".

By forming the cam peripheral part 170*a* of the operating cam 170 in such a way, a member that is brought into contact with the cam peripheral part 170*a* can be operated smoothly.

A first day correction transmitting wheel (not illustrated) and a second day correction transmitting wheel 180 are integrated with the same rotational center. The first day correction transmitting wheel and the second day correction transmitting wheel 180 are integrally rotated. The second day correction transmitting wheel 180 is in mesh with the intermediate day wheel driving gear 158.

The hammer 182 is oscillatably integrated between the auxiliary plate 104 and the auxiliary train wheel bridge 124. A cam contact portion 182*a* of the hammer 182 is brought into contact with the cam peripheral part 170*a* of the operating cam 170. A teeth portion 182*b* of the hammer 182 is in mesh with a small day wheel 184.

A small day wheel spring 186 is integrated to provide the small day wheel 184 with a force for rotating the small day wheel 184 always in one direction. One end of the small day wheel spring 186 is fixed to a stationary part constituting the movement 100 and other end is fixed to a portion proximate to the rotational center of the small day wheel 184. The small day wheel spring 186 is preferably fixed to, for example, the auxiliary plate 104.

The small day wheel spring 186 is preferably constituted by a spiral spring. The small daywheel spring 186 is preferably constituted by a spring material having a high spring constant. The turn number of the small day wheel spring 186 is preferably between 2 turns through 10 turns. It is further preferable that the turn number of the small day wheel spring 186 is between 3 turns through 6 turns.

Urging means for pressing the hammer 182 to the operating cam 170 may be used in place of the small day wheel spring 186. The urging means provides the force for rotating the small day wheel 184 always in one direction to the small day wheel 184. The urging means is preferably constituted by a leaf spring, a U-shape spring, a line spring, a helical spring or the like. The urging means may integrally be provided with the hammer 182.

By such a constitution, the hammer 182 is oscillated in a range of a predetermined angle by rotation of the operating cam 170. As a result, the small day wheel 184 is rotated in a range of a predetermined angle.

On or more of planar portions 184*a* are formed at a nail attaching portion of the small day wheel 184. The day hand 240 is fixed to the nail attaching portion of the small day wheel 184. The hand is prevented from loosening by the planar portions 184*a* when the hand performs returning operation.

According to the embodiment of the present invention, the rotational center of the small day wheel 184 is disposed in an intermediate direction between the 2 o'clock direction and the 3 o'clock direction of the timepiece at an external side of the intermediate point of the radius of the main plate 102. The rotational center of the small day wheel 184 may be provided substantially in the 2 o'clock direction of the timepiece.

It is preferable that the rotational center of the small day wheel 184 is disposed in a direction between the 1 o'clock direction and the 5 o'clock direction of the timepiece at a position of substantially 40% through 90% of the radius of the main plate 102. It is further preferable that the rotational center of the small day wheel 184 is disposed in a direction between the 2 o'clock direction and the 4 o'clock direction of the timepiece at a position of substantially 50% through 70% of the radius of the main plate 102. It is still further preferable that the rotational center of the small day wheel 184 is disposed in a direction between the 2 o'clock direction and the 4 o'clock direction of the timepiece at an external side of the intermediate point of the radius of the main plate 102. It is particularly preferable that the rotational center of the small day wheel 184 is disposed in a direction proximate to the 3 o'clock direction of the timepiece at the external side of the intermediate point of the radius of the main plate 102.

According to the constitution, display of day and date of the multi-functional timepiece of the present invention is provided with a structure that is large and very easy to see.

A crown wheel 190 is in mesh with a winding pinion 192. The winding pinion 192 is integrated to the winding stem 106. The crown wheel 190 is in mesh with a day-date corrector wheel 194. The crown wheel 190 is in mesh with a sliding crown wheel 196. The sliding crown wheel 196 is in mesh with a square hole wheel 198. The sliding crown wheel 196 is integrated to be positioned in one direction by a sliding crown wheel spring 197 and movably in other direction.

When the sliding crown wheel 190 is rotated in one direction, rotation of the crown wheel 190 rotates the square hole wheel 198 via rotation of the sliding crown wheel 196. The square hole wheel 198 is constituted to rotate integrally with the complete barrel with main spring 108. Accordingly, thereby, the power spring is wound.

When the crown wheel 190 is rotated in other direction, rotation of the crown wheel 190 idles the sliding crown wheel 196 and the sliding crown wheel 196 does not rotate the square hole wheel 198. As a result, the square hole wheel 198 is rotated always in one direction by the crown wheel 190.

(2) Structure of 24 Hour Display Portion

An intermediate small hour hand wheel gear 202 is integrated to be in mesh with the hour wheel gear 114. An intermediate small hour hand wheel and pinion 204 is constituted by the intermediate small hour hand wheel gear and an intermediate small hour hand pinion 206. A small hour hand wheel 208 is integrated to be in mesh with the intermediate small hour hand pinion 206. The small hour hand wheel 208 is constituted to make 1 rotation per 24 hours.

According to the embodiment of the present invention, the rotational center of the small hour hand wheel 208 is disposed in the 9 o'clock direction of the timepiece at a portion proximate to substantially the intermediate point of the radius of the main plate 102.

It is preferable that the rotational center of the small hour hand wheel 208 is disposed in the 9 o'clock direction of the timepiece at a position of substantially 30% through 70% of the radius of the main plate 102. It is further preferable that the rotational center of the small hour hand wheel 208 is disposed in the 9 o'clock direction of the timepiece at a position of substantially 40% through 60% of the radius of the main plate 102. It is still further preferable that the rotational center of the small hour hand wheel 208 is disposed in the 9 o'clock direction of the timepiece at a portion proximate to substantially the intermediate point of the radius of the main plate 102.

According to the constitution, time display in the 24 hour system that is large and easy to see can be provided.

It is further preferable that the multi-functional timepiece of the present invention is provided with the time display in the 24 hour system along with the day display.

(3) Structure of Dial and Hand Portion

Figure 5:
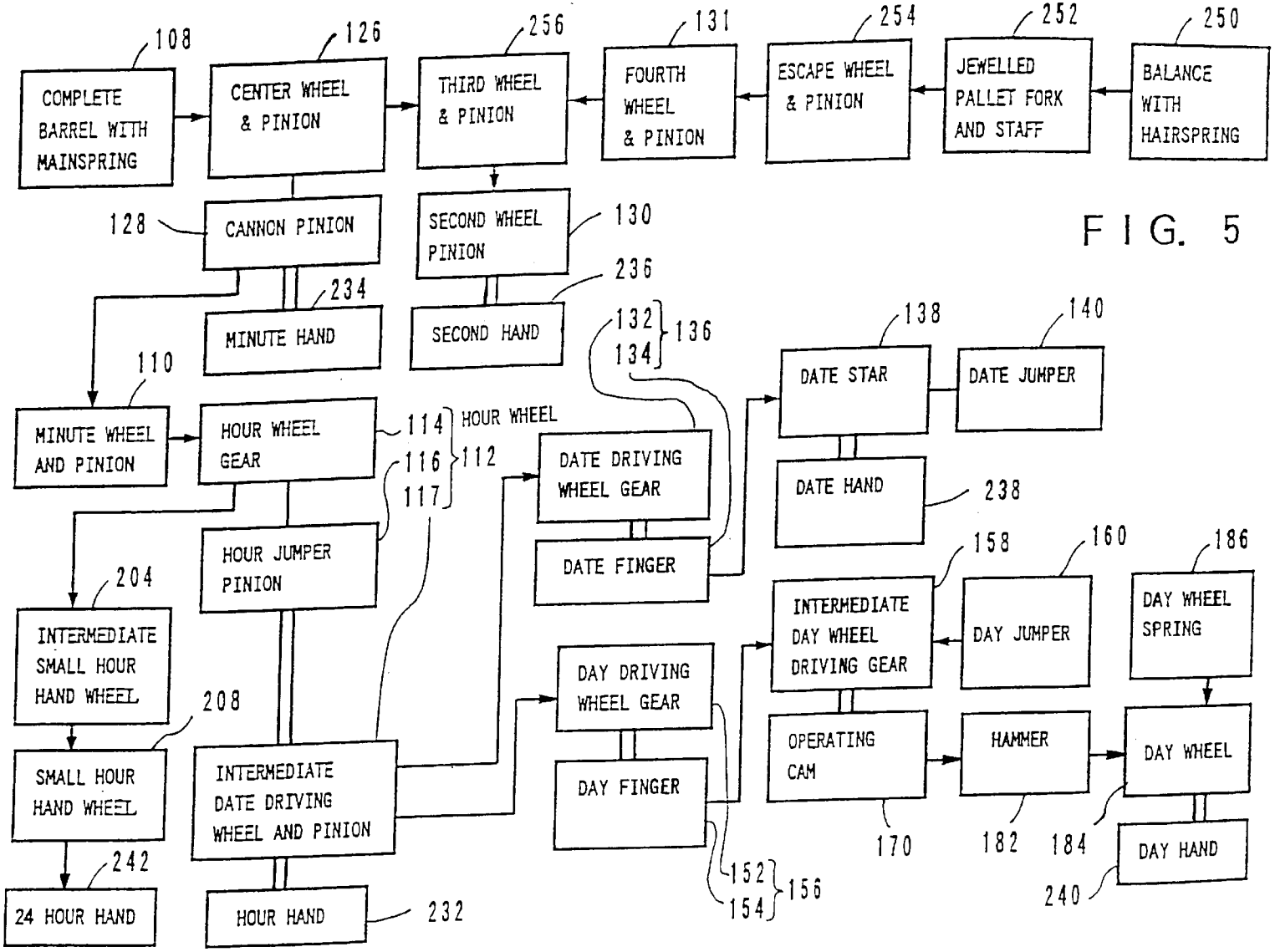
FIG. 5 is an outline block diagram showing the embodiment of the multi-functional timepiece of the present invention.

Referring to FIG. 2, FIG. 3 and FIG. 5, the dial 230 is integrated to the auxiliary train wheel bridge 124. The hour hand 232 is fixed to the hour wheel 112. The minute hand 234 is fixed to the cannon pinion 128. The second hand 236 is fixed to the second wheel pinion 130. The date hand 238 is fixed to the date star 138. The day hand 240 is connected to the small day wheel 184. The 24 hour hand is fixed to the small hour hand wheel 208. Letters or notations or the like for displaying time, date, day and time of 24 hour are provided on the dial. The lengths and the attaching heights of the respective hands are constituted such that they are not brought into contact with other parts.

(4) Structure of Obverse Side of Movement of Timepiece

Next, an explanation will be given of the structure of the obverse side of the embodiment of the multi-functional mechanical watch according to the present invention.

Figure 4:
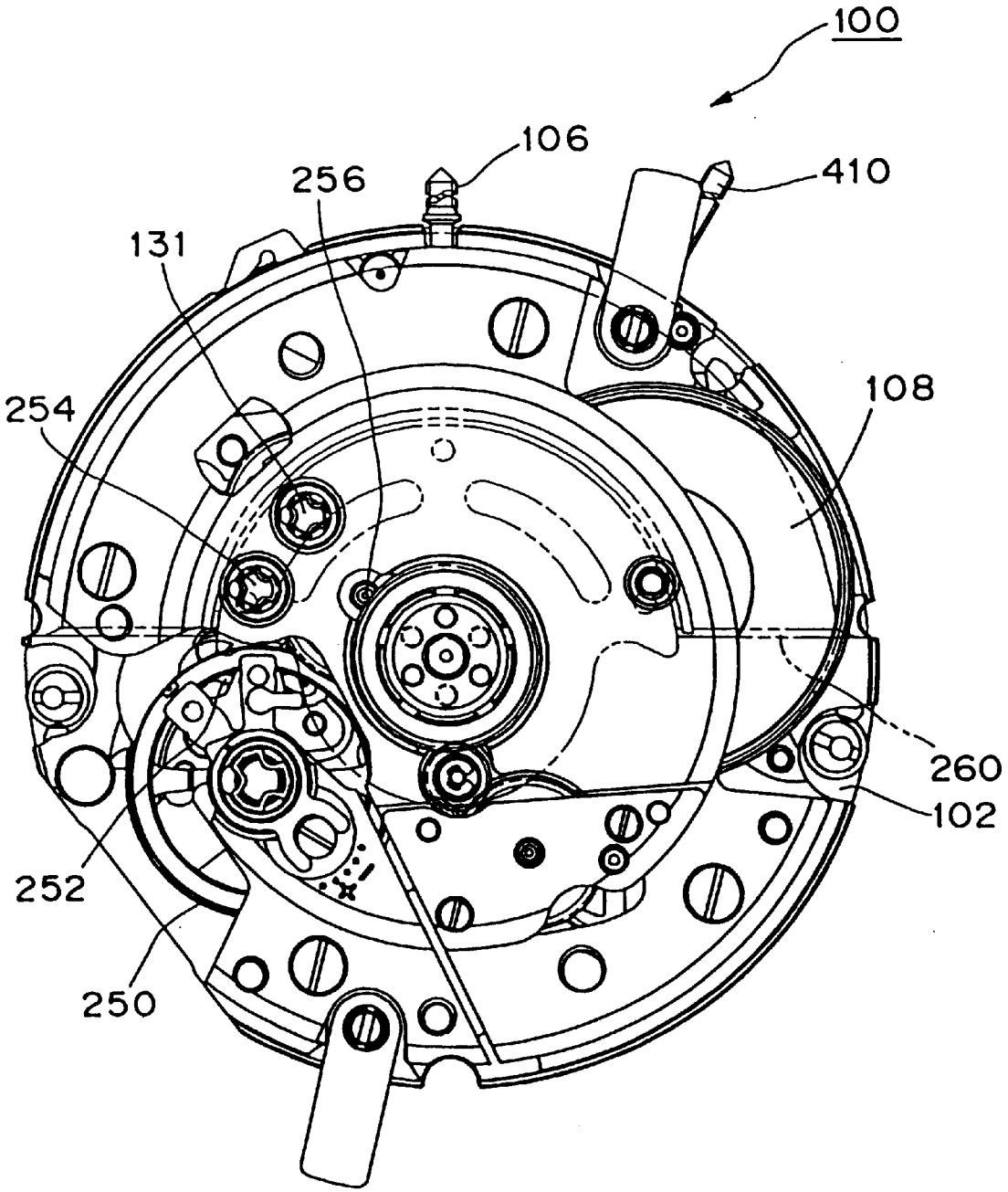
FIG. 4 is a outline plane view showing a structure of an obverse side portion according to an embodiment of a multi-functional mechanical timepiece of the present invention.

Referring to FIG. 4, the complete barrel with main spring 108 is integrated to the obverse side of the main plate 102. A balance with hairspring 250 is integrated to the main plate 102 on the side of the center wheel and pinion 126 opposed to the complete barrel with main spring 108. A jewelled pallet fork and staff 252 is integrated to engage with the balance with hairspring 250. An escape wheel and pinion 254 is integrated to engage with the jewelled pallet fork and staff 252. A third wheel and pinion 256 is integrated to be in mesh with the center wheel and pinion 126 and a fourth wheel and pinion 130.

A rotational weight 260 shown by imaginary lines is integrated on the obverse wheel train portion. An automatic winding portion (not illustrated) and an automatic wheel train (not illustrated) are integrated to cooperatingly move with the rotational weight 260. The automatic winding wheel train is constituted to wind up the power spring of the complete barrel with main spring 108.

(5) Operation of Obverse Side of Movement, Calendar Portion and 24 Hour Display Portion Next, a detailed explanation will be given of the operation of the obverse portion of the movement, the calendar portion and the 24 hour display portion according to the embodiment of the multi-functional mechanical watch of the present invention.

Referring from FIG. 1 through FIG. 5, the power spring (not illustrated) arranged in the complete barrel with main spring 108 constitutes the power source of the timepiece. The complete barrel with main spring 108 is rotated by the force of the power spring. The center wheel and pinion 126 is rotated by rotation of the complete barrel with main spring 108. The third wheel and pinion 256 is rotated by rotation of the center wheel and pinion 126. The fourth wheel and pinion 131 is rotated by rotation of the third wheel and pinion 256. The second wheel pinion 130 is rotated by rotation of the third wheel and pinion 256.

The cannon pinion 128 is rotated by rotation of the center wheel and pinion 126 integrally therewith. The minute wheel and pinion 110 is rotated by rotation of the cannon pinion 128. The hour wheel 112 is rotated by rotation of the minute wheel and pinion 110.

The intermediate small hour wheel and pinion 204 is rotated by rotation of the hour wheel gear 114. The small hour hand wheel 208 is rotated by rotation of the intermediate small hour wheel and pinion 204. The small hour hand wheel 208 is rotated at a rotational speed of a half of a rotational speed of the hour wheel 112.

The rotational speeds of the respective wheel trains are controlled by motion of the jewelled pallet fork and staff 252 and the escape wheel and pinion 254. As a result, the second wheel and pinion 130 is rotated by 1 rotation per minute. The cannon pinion 128 and the center wheel and pinion 126 are rotated by 1 rotation per hour. The hour wheel 112 is rotated by 1 rotation per 12 hours. The small hour hand wheel 208 is rotated by 1 rotation per 24 hours.

The hour wheel gear 114 is rotated by rotation of the minute wheel and pinion 110. The hour jumper pinion 116 and the intermediate date driving wheel and pinion 117 are rotated integrally with the hour wheel gear 114. The date driving wheel gear 132 is rotated by rotation of the intermediate date driving wheel and pinion 117. The date star 138 is intermittently driven by the date finger 134 once per day such that the date display is changed by one day. That is, the date star 138 is rotated by 1/31 rotation once per day.

The day indicator driving wheel gear 152 is rotated by rotation of the intermediate date driving wheel and pinion 117. The intermediate day wheel driving gear 158 is intermittently driven by the day finger 154 once per day. The operating cam 170 is rotated integrally with the intermediate day wheel driving gear 158.

The hammer 182 is oscillated by being brought into contact with the cam peripheral part 170*a* of the operating cam 170. The small daywheel 184 is rotatedby rotation of the teeth portion 182*b* of the hammer 182.

"Second" is displayed by the second hand 236 attached to the second wheel pinion 130. "Minute" is displayed by the minute hand 234 attached to the cannon pinion 128. "Hour" is displayed by the hour hand 232 attached to the intermediate date driving wheel and pinion 117 by a unit of 12 hours. "Date" is displayed by the date hand 238 attached to the date star 138. "Day" is displayed by the day hand 240 attached to the small day wheel 184. "Hour" is displayed by the 24 hour hand 242 attached to the small hour hand wheel 208 by a unit of 24 hours.

That is, the second wheel pinion 130, the cannon pinion 128 and the center wheel and pinion 126, the hour wheel 112 and the small hour hand wheel 208 constitute time information indicating wheels for displaying time information.

The date star 138 and the small day wheel 183 constitute calendar information indicating wheels for displaying information with respect to calendar of date, day of week and the like. Information with respect to time and calendar is read by division or the like of the dial 230.

(6) Operation of Day Display Portion

Next, a detailed explanation will be given of the operation of a day display portion of the embodiment of the multi-functional timepiece according to the present invention.

Figure 6:
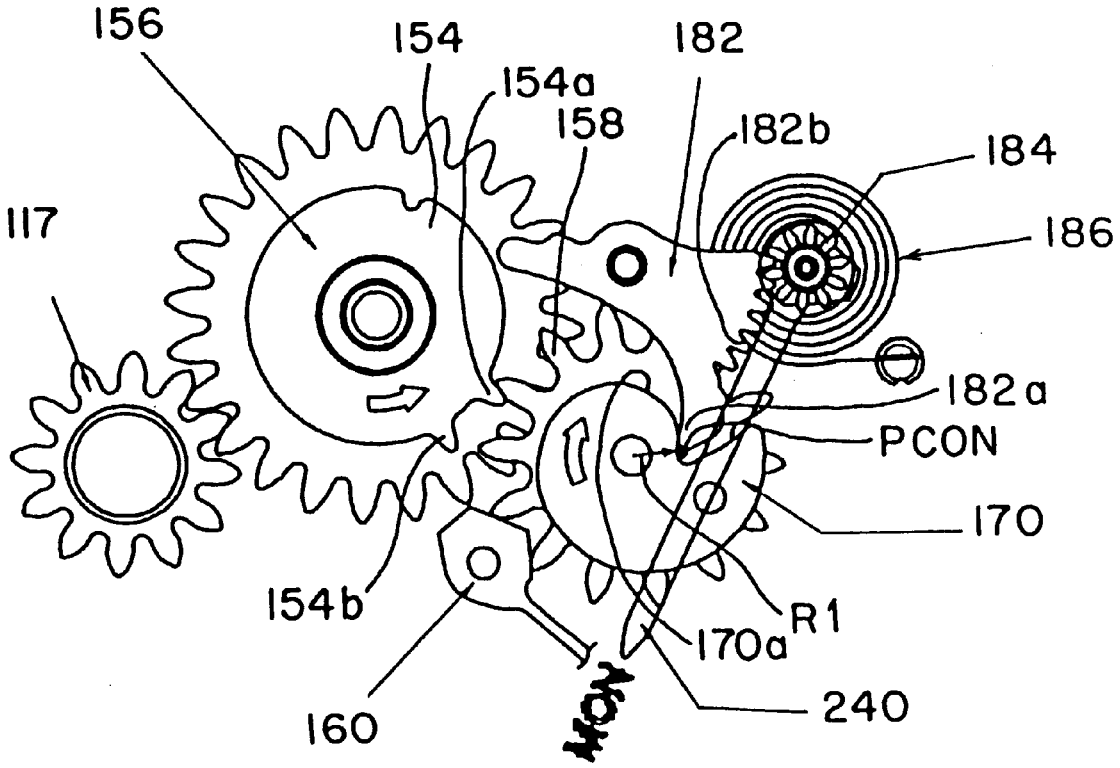
FIG. 6 is an outline partial plane view showing a state where the calendar portion indicates Monday according to the embodiment of the multi-functional timepiece of the present invention.

Referring to FIG. 6, the day indicator driving wheel 156 is rotated by rotation of the intermediate day driving wheel and pinion 117. The intermediate day wheel driving gear 158 is intermittently rotated by the day finger 154. The intermediate day wheel gear 158 is provided with 14 teeth. The day finger driving portions 154*a* and 154*b* rotate the intermediate day wheel driving gear 158 by 2 teeth per day.

The operating cam 170 is rotated integrally with the intermediate day wheel driving gear 158. The cam contact portion 182*a* of the hammer 182 is oscillated by being brought into contact with the cam peripheral part 170*a* of the operating cam 170. The teeth portion 182*b* of the hammer 182 is in mesh with teeth of the small day wheel 184. The small day wheel 184 is rotated by rotation of the hammer 182.

The small day wheel spring 186 applies a force in the anticlockwise direction in view of FIG. 6 on the small day wheel 184. The cam contact portion 182*a* of the hammer 182 is pressed to the cam peripheral part 170*a* of the operating cam 170 by the force of the small day wheel spring 186.

The cam peripheral part 170*a* of the operating cam 170 is formed such that the radius R1 from the rotational center of the operating cam 170 is changed along the circumferential direction. That is, the radius from the rotational center of the operating cam 170 is continuously increased in the circumferential direction and in the anticlockwise direction and a first portion minimizing the distance is provided next to a portion maximizing the distance.

According to the state shown by FIG. 6, the cam contact portion 182*a* of the hammer 182 is brought into contact with the first position proximate to a part having a minimum radius R1 of the cam peripheral portion 170*a*. Accordingly, the small day wheel 184 is disposed at a first position of being rotated by the largest amount in the anticlockwise direction within a region where the day hand 240 can indicate. In this case, the day hand 240 indicates a letter "MON" showing Monday described on the dial.

Figure 7:
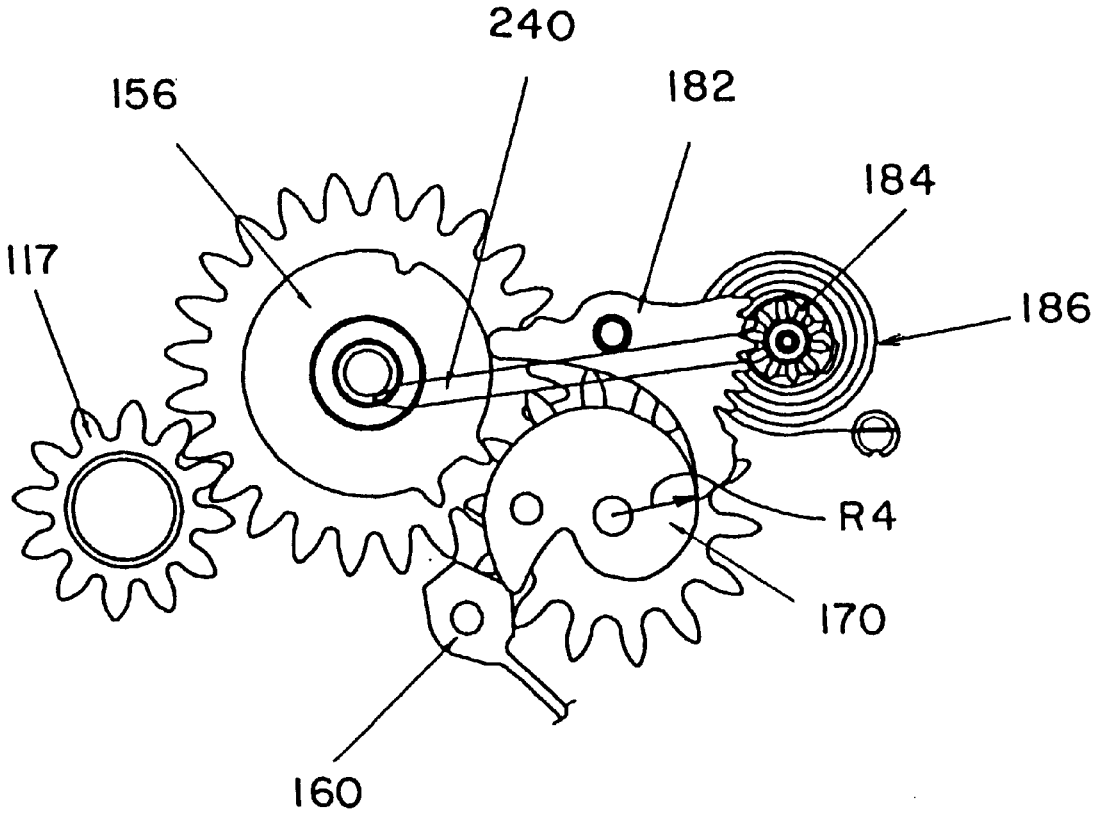
FIG. 7 is an outline partial plane view showing a state where the calendar portion indicates Thursday according to the embodiment of the multi-functional timepiece of the present invention.

Next, referring to FIG. 7, according to the state shown by FIG. 7, the cam contact portion 182*a* of the hammer 182 is brought into contact with a fourth position where a radius R4 of the cam peripheral part 170*a* is provided with a fourth size. Accordingly, the small day wheel 184 is disposed at a fourth position of being rotated by 3 stages from the first position in the clockwise direction. In this case, the day hand 240 indicates a letter "THU" (not illustrated) showing Thursday described on the dial.

Figure 8:
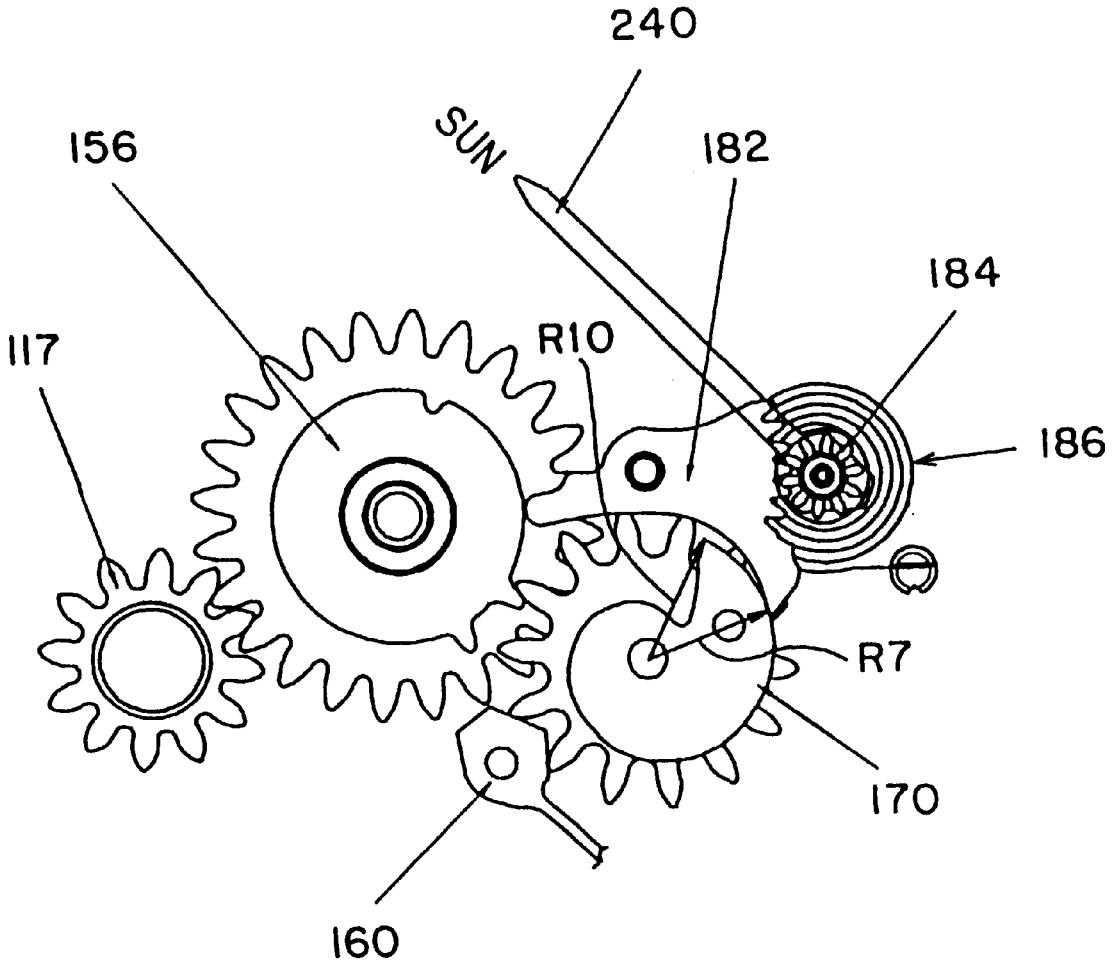
FIG. 8 is an outline partial plane view showing a state where the calendar portion indicates Sunday according to the embodiment of the multi-functional timepiece of the present invention.

Next, referring to FIG. 8, according to the state shown by FIG. 8, the cam contact portion 182*a* of the hammer 182 is brought into contact with a seventh position where a radius R7 of the cam peripheral part 170*a* is provided with a seventh size. Accordingly, the small day wheel 184 is disposed at a seventh position of being rotated by 6 stages from the first position in the clockwise direction. In this case, the day hand 240 indicates a letter "SUN" showing Sunday described on the dial.

When the operating cam 170 is further rotated, the cam contact portion 182*a* of the hammer 182 is rotated to exceed a portion where the radius of the cam peripheral part 170*a* becomes a maximum value of R10 and is brought into the state shown by FIG. 6. Accordingly, the day hand 240 indicates the letter "MON" showing Monday next to the letter "SUN" showing Sunday.

Accordingly, the radius R of the cam peripheral portion 170*a* is constituted to be in proportion to an angle along the rotational direction of the cam in the circumferential direction. As a result, by rotation of the operating cam 170, the day hand 240 can display Monday through Sunday by successively indicating the seven letters on the dial.

In this case, by providing one idler between the hammer 182 and the small day wheel 184, the rotational direction of the small day wheel 184 can be reversed. By this constitution, a timepiece where Sunday is displayed in the state shown by FIG. 6 and Monday is displayed in the state shown by FIG. 8 can be realized.

Figure 9:
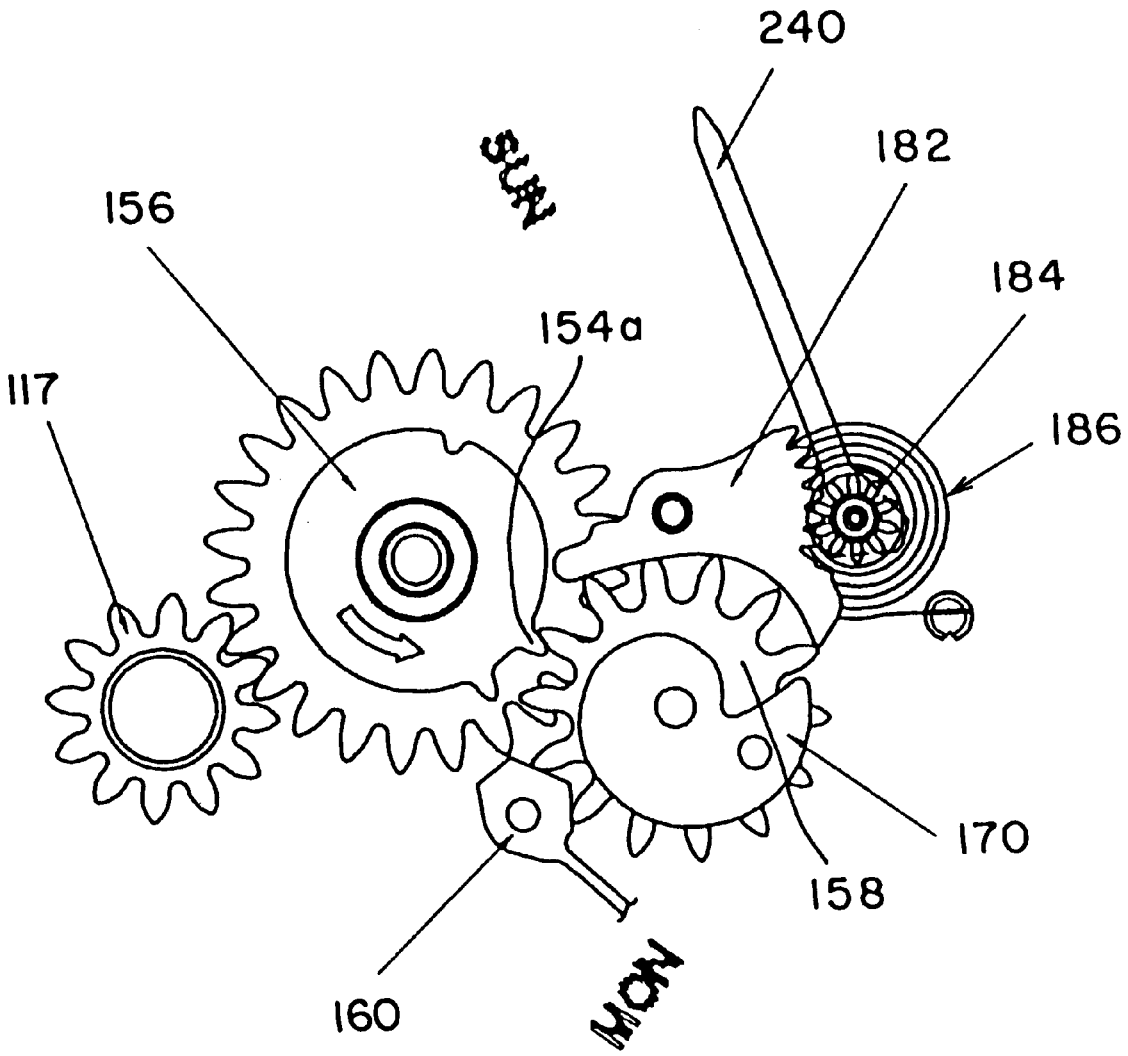
FIG. 9 is a first outline partial plane view showing a state of day driving of the calendar portion according to the embodiment of the multi-functional timepiece of the present invention.
Figure 10:
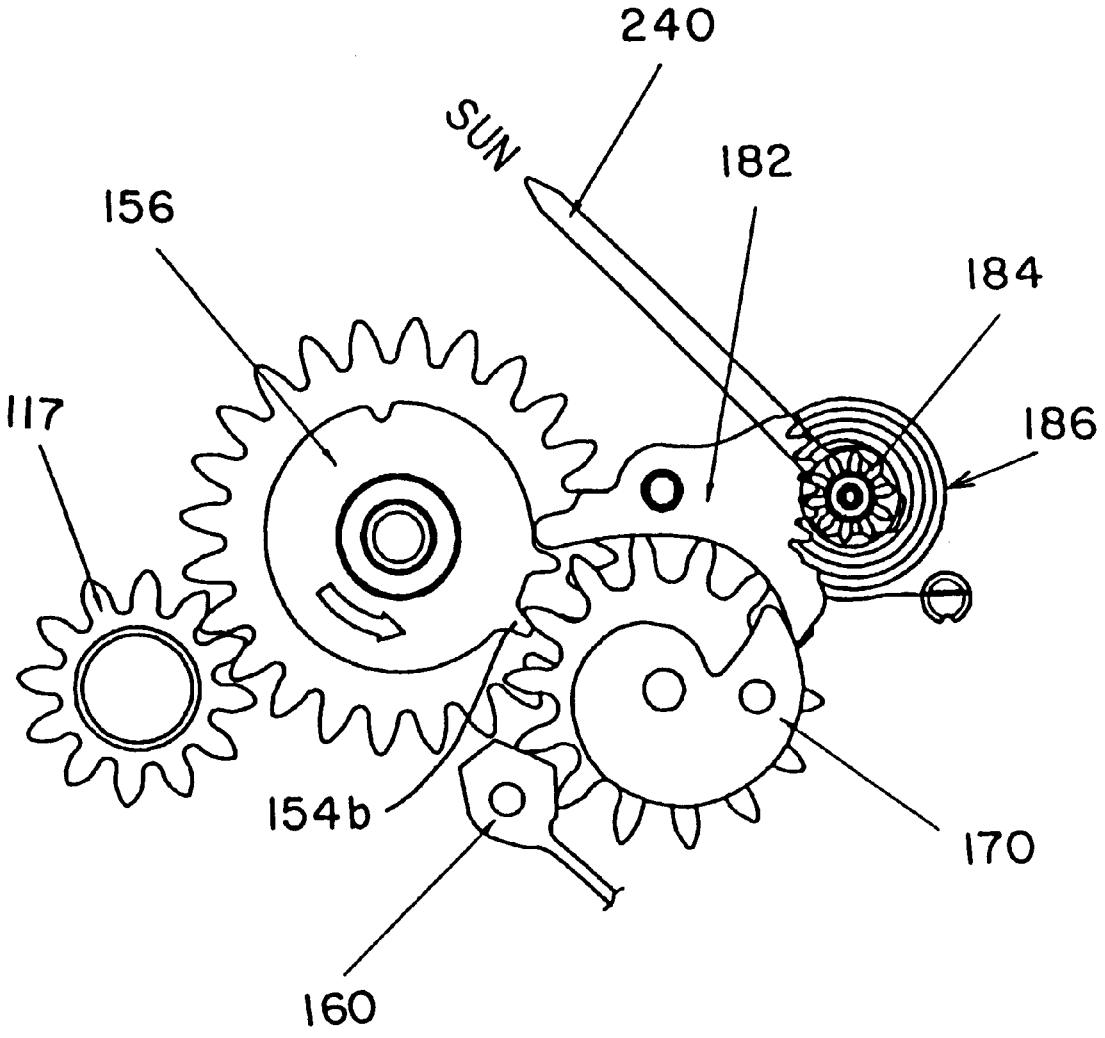
FIG. 10 is a second outline partial plane view showing a state of day driving of the calendar portion according to the embodiment of the multi-functional timepiece of the present invention.

Referring to FIG. 9, the day finger driving portion 154*a* rotates the intermediate day wheel driving gear 158 by one tooth per day. Successive to the operation, as shown by FIG. 10, the day finger driving portion 154*b* rotates the intermediate day wheel driving gear 158 by one tooth per day.

In this way, the intermediate day wheel driving gear 158 can be rotated by 1/7 rotation once per day.

In this case, the intermediate day wheel driving gear 158 may be constituted to rotate by 1/7 rotation once per day by one day finger.

Further, a number of teeth of the intermediate day wheel driving gear 158 is not limited to 14 but may be a number of an integer multiplied by 7 such as 7 or 21 or the like. Also in this case, the day finger may be constituted such that the intermediate day wheel driving gear 158 is rotated by 1/7 rotation once per day by the day finger.

According to the multi-functional timepiece of the present invention, the day hand 240 moves in a region of a fan shape. Meanwhile, according to the conventional multi-functional timepiece, the day hand moves in a region of a circular shape. Accordingly, the letters showing days of week of the multi-functional timepiece of the present invention are larger than letters showing days of week of the conventional multi-functional timepiece. As a result, display of day of week of the multi-functional timepiece of the present invention is very easy to see.

(7) Detailed Explanation of Structure of Day Display Portion

A further detailed explanation will be given of the structure of day display portion in reference to FIG. 6 and FIG. 8.

As shown by FIG. 6, when Monday is displayed, the radius R1 of the cam peripheral portion 170*a* of the operating cam 170 is determined to be a value proximate to the minimum cam radius RMIN of the cam.

As shown by FIG. 8, when Sunday is displayed, the radius R7 of the cam peripheral portion 170*a* of the operating cam 170 is determined to be a value proximate to the maximum cam radius RMAX of the cam.

The radius RCAM of the cam peripheral portion 170*a* is calculated by the following equation.

$$RCAM=RMIN+a*SCAM$$

In this equation, notation "a" designates a coefficient showing a change of a shape of the cam peripheral portion 170*a* and notation SCAM designates a rotational angle of the operating cam 170 which is a value designated by radian. In this case, 2π radian is 360°.

Accordingly, when the operating cam 170 is rotated by 1 rotation, SCAM is provided with a value between 0 through 2π.

As a result, the maximum value RMAX of the radius RCAM of the cam peripheral portion 170*a* is shown by the following equation.

$$RMAX=RMIN+2\pi a$$

Assume that a point where the hammer 182 is brought into contact with the operating cam 170 is designated by notation PCON. Assume that a distance between the rotational center of the hammer 182 and the point PCON is designated by notation RLEV.

When the operating cam 170 is rotated by 1rotation, the point PCON is rotated by an arc length of 2πa along the circular arc of the radius RLEV. Here, assume that the arc length of the portion is substantially equal to the length of the circular arc of the portion.

As a result, a rotational angle SLEV of the hammer 182 when the operating cam 170 is rotated by 1 rotation is shown below.

$$SLEV=2\pi a/RLEV$$

When the hammer 182 is rotated by a maximum amount, an angle SWEEK by which the small day wheel 184 is rotated is specified below.

$$SWEEK=SLEV*(DLEV/DWEEK)$$

In the above equation, notation DLEV designates a diameter of the pitch circle of the gear of the hammer 182 in mesh with the small day wheel 184 and notation DWEEK designates the diameter of the pitch circle of the small day wheel 184. The angle SWEEK is a value displayed by radian.

Dimensions of respective parts can be determined by such conditions.

For example, an explanation will be given of a way of determining dimensions of respective parts in the case where day display is performed in a range of 110°. That is, the day hand 240 is rotated by 110° from Monday to Sunday. 110° in radian display is as shown below.

$$2\pi/360=x\text{radian}/110°$$

Accordingly, $$x=27*110/360=\text{about } 1.9 \text{ radian.}$$

The minimum cam radius RMIN is set to 0.6 mm and the maximum cam radius RMAX is set to 0.7 mm.

According to the equation showing the radius RCAM of the cam peripheral portion 170*a*, $$RCAM=RMIN+a*SCAM$$

Accordingly, $$1.7=0.6+a*2\pi.$$

Accordingly, a=about 0.18.

In this case, the distance RLEV between the rotational center of the hammer 182 and the point PCON is set to 2.5 mm.

As a result, a relationship between the diameter DLEV of the pitch circle of the gear of the hammer 182 and the diameter DWEEK of the pitch circle of the small daywheel 184 is specified below.

$$1.9 = SLEV * (DLEV / DWEEK)$$

$$= (2\pi a / RLEV) * (DLEV / DWEEK)$$

As a result, the following values are specified, for example, as an example of outline dimensions of the diameter DLEV of the pitch circle of the gear of the hammer 182 and the diameter DWEEK of the pitch circle of the small day wheel 184.

DLEV=3.7 mm

DWEEK=0.9 mm

In this case, the radius RCAM of the cam peripheral portion 170*a* is determined by the following equation.

$$RCAM=RMIN+a*SCAM$$

However, in actually fabricating the cam peripheral portion 170*a*, a shape proximate thereto may be formed by a combination of a plurality of curves on the basis of the curve of the equation. Further, the actual shape of the cam peripheral portion 170*a* may be formed by a combination of a plurality of straight lines or by a combination of one or more curves and one or more straight lines. In this case, the above-described curve may be a circular arc or may be a curve of cycloid or involute or the like.

When the cam peripheral portion 170*a* is formed by a plurality of curves or a plurality of straight lines, it is preferable that after forming the cam outer peripheral portion 170*a*, the cam outer peripheral portion 170*a* is subjected to, for example, polishing or barrel polishing or the like to make smooth the cam peripheral portion 170*a*.

The teeth shape of the gear of the hammer 182 and the teeth shape of the gear of the small day wheel 184 can be determined based on the values of the diameters of the pitch circles of these gears.

By constituting in this way, display of days of week from Monday to Sunday can be carried out in the range of 110°. As a result, an angle between the position of the day hand 240 at Monday and the position of the day hand 240 at Tuesday is 110°/6 that is about 18.33°. Similarly, angles between the positions of the day hand 240 of the respective days are about 18.33°.

Here, according to the above explanation, the radius RCAM of the cam peripheral portion 170*a* is determined by the above-described equation of $$RCAM=RMIN+a*SCAM.$$

However, the radius RCAM may not be necessarily of a monotonously increasing shape. That is, when the operating cam 170 is rotated by 1 rotation, the above-described coefficient "a" may not always take a constant value.

When the radius RCAM of the cam peripheral portion 170*a* is determined in this way, a display where angles among respective day displays are different from each other can be realized.

For example, assume that an angle between a position of the day hand 140 at Monday and a position of the day hand 240 at Tuesday is 12°. Similarly, assume that an angle between a position of the day hand 240 at Tuesday and a position of the day hand 240 at Wednesday, an angle between a position of the day hand 240 at Wednesday and a position of the day hand 240 at Thursday and an angle between a position of the day hand 240 at Thursday and a position of the day hand 240 at Friday, are respectively 12°.

Further, an angle between a position of the day hand 240 at Friday and a position of the day hand 240 at Saturday, and an angle between a position of the day hand 240 at Saturday and a position of the day hand 240 at Sunday, are respectively 31°.

By this constitution, letters of Saturday and Sunday on the dial can be made larger than letters of other days of week. As a result, display of weekend is particularly emphasized and easy to see.

(8) Structure for Adjusting Phases of Date Driving Wheel and Day Indicator Driving Wheel Next, an explanation will be given of the constitution for adjusting phases of the date driving wheel 132 and the day indicator driving wheel 156 in the rotational direction.

Figure 11:
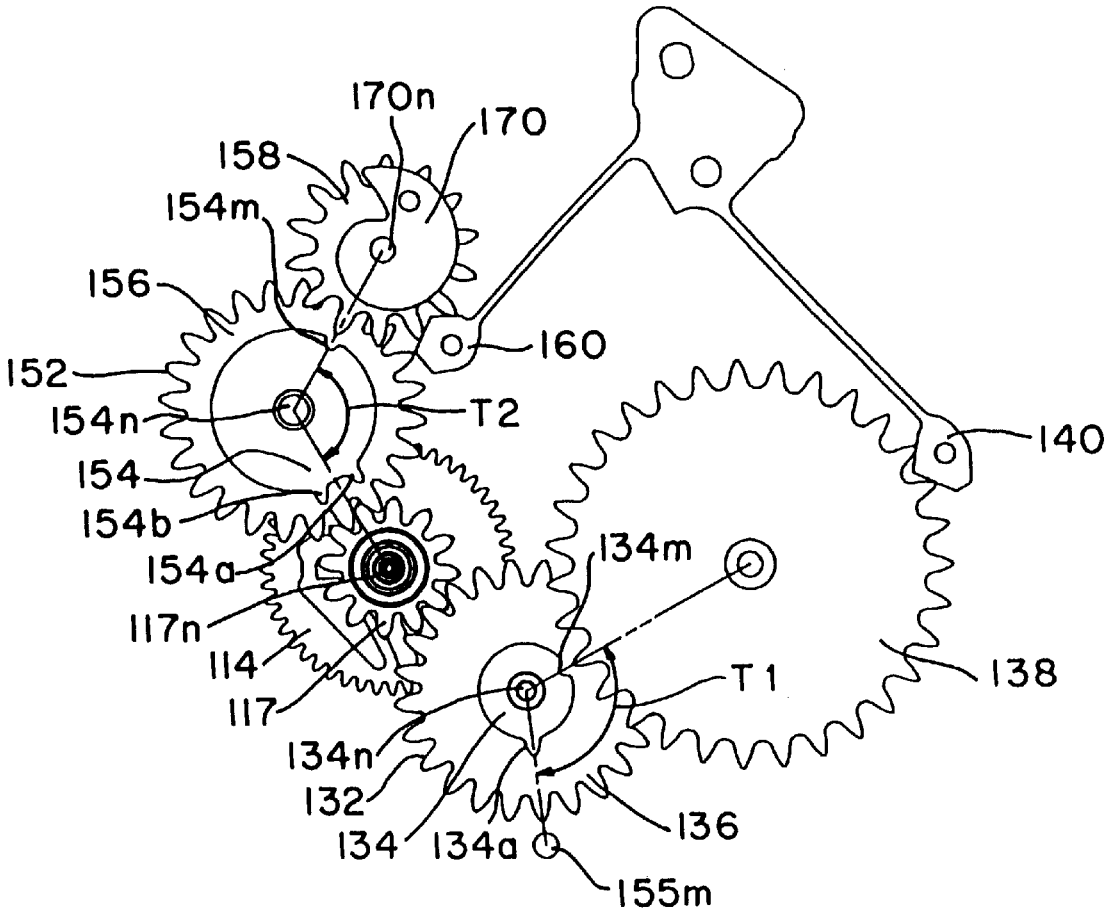
FIG. 11 is an outline partial plane view for explaining adjustment of phases of a driving wheel and a day indicator driving wheel of the calendar portion according to the embodiment of the multi-functional timepiece of the present invention.
Figure 12:
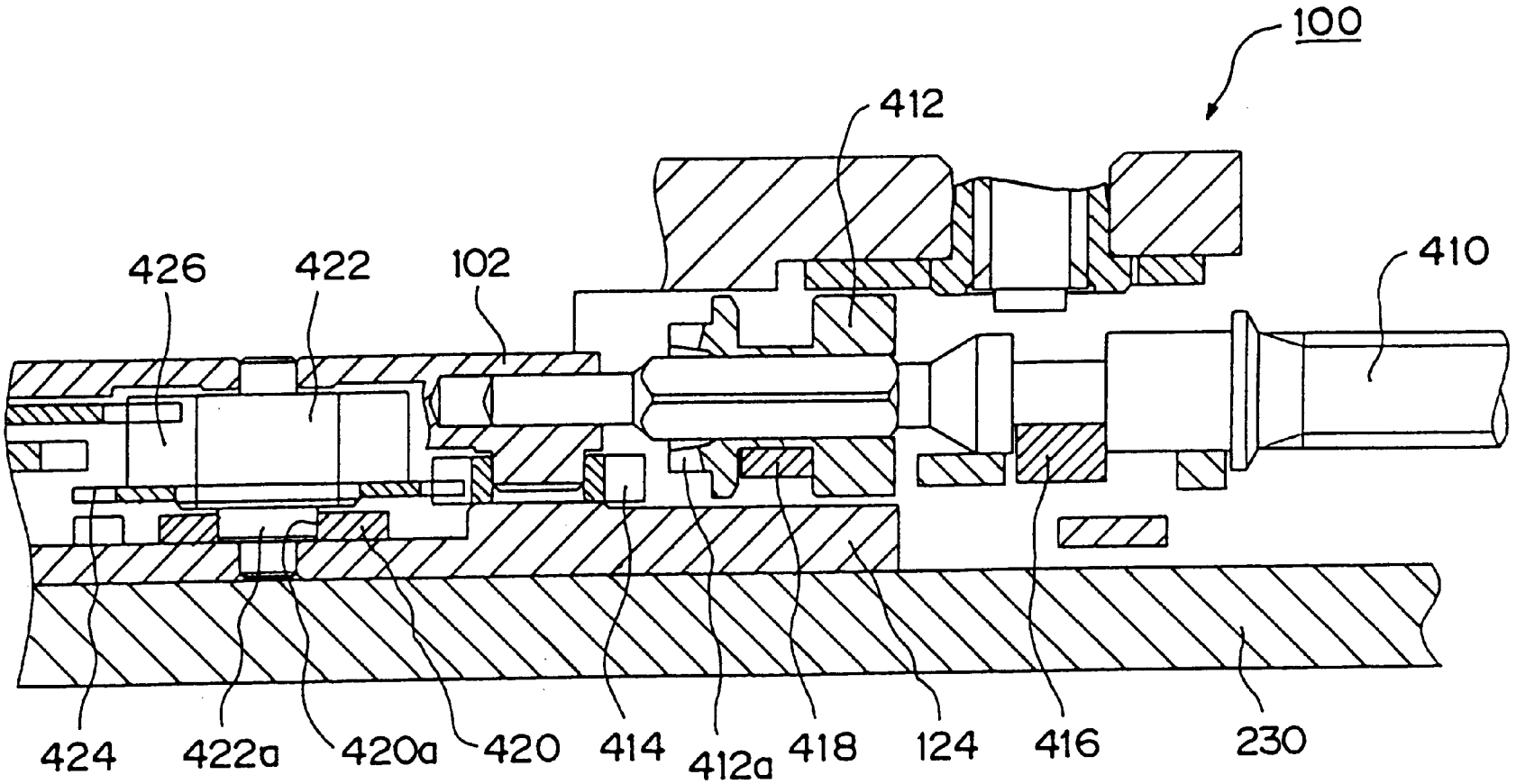
FIG. 12 is a first partial sectional view showing a time correcting portion according to the embodiment of the multi-functional timepiece of the present invention.

Referring to FIG. 11, the date finger 134 is rotated centering on a rotational center 134*n*. The day finger 154 is rotated centering on a rotational center 154*n*. The date finger 134 is provided with a date finger position indicating notch 134*m* for indicating the position in the rotational direction of a date finger driving portion 134*a* of the date finger 134. The day finger 154 is provided with a day finger position indicating notch 154*m* for indicating the positions in the rotational direction of day finger driving portions 154*a* and 154*b* of the day finger 154.

Assume that an angle made by a line connecting the date finger position indicating notch 134*m* and the date finger rotational center 134*n* and a line connecting the date finger driving portion 134*a* and the date finger rotational center 134*n*, is designated by notation T1.

Assume that an angle made by a line connecting the day finger position indicating notch 154*m* and the day finger rotational center 154*n* and a middle point between the day finger driving portions 154*a* and 154*b* and the day finger rotational center 154*n*, is designated by notation T2.

A date finger portion target mark 155*m* is provided at a location which can be seen from the rear side of the main plate 102, the auxiliary plate 104, or the auxiliary train wheel bridge 124 or the like.

In integrating the date finger 134 to the movement, the date finger 134 is integrated by directing the date finger position indicating notch 134*m* toward the date finger portion target mark 155*m*.

In integrating the day finger 154 to the movement, the day finger 154 is integrated by directing the day finger position indicating notch 154*m* toward a rotational center 170*n* of the operating cam 170.

In this case, the angle T1 and the angle T2 are constituted to be substantially equal to each other. By this constitution, firstly, the intermediate day wheel driving gear 158 is driven by one tooth by the day finger driving portion 154*a*. Next, the date star 138 is driven by one tooth by the date finger driving portion 134*a*.

Finally, the intermediate day wheel driving gear 158 is driven by one tooth by the day finger driving portion 154*b*. As a result, date driving and day driving are finished in a short period of time. Further, the maximum value of the spring force by the day jumper 140 in the day driving operation and the maximum value of the spring force by the day jumper 160 in the day driving operation are not caused simultaneously. Accordingly, large load is not applied on the driving portion and the operation of the timepiece can be stabilized.

Means for adjusting the phases may be either of a notch, a hole, a projection, a mark and the like. By the constitution, integration of parts is extremely facilitated and quality of phase adjustment is extremely high.

According to the constitution, for example, a first tooth of the intermediate day wheel driving gear 158 is driven from around 10 o'clock and 30 minutes in the afternoon. Further, the date star 138 is driven by around 0 o'clock in the morning. Further, a second tooth of the intermediate day wheel driving gear 158 is driven from around 0 o'clock in the morning to 1 o'clock in the morning.

In this case, the difference between the angle T1 and the angle T2 is preferably 45° or less. By this constitution, the difference between time of starting date driving operation and time of starting day driving operation can be made about 3 hours. Accordingly, when the date driving operation is started at 11 o'clock in the afternoon, the day driving operation is performed at around 2 o'clock in the morning.

(9) Operation of Switch Portion and Calendar Correcting Portion

Next, a brief explanation will be given of operation of the switch portion and the calendar correcting portion of the present invention.

Normally, when a wrist watch is carried at the arm, the winding stem 106 is disposed at the 0-th stage.

Next, when correction of display of date and day is performed, the winding stem 106 is drawn to the 1-th stage. In this case, by rotation of a tooth 112*b* of the clutch wheel 118, the winding pinion 192 and the crown wheel 190 are rotated. By rotating the winding stem 106 in the first direction under this state, the calendar correcting wheel 146 receives the rotational force of the crown wheel 190, the calendar oscillation correcting lever 148 is oscillated in the first direction and rotates the first date correction transmitting wheel 142 and the second date correction transmitting wheel 144. The date star 138 is rotated by rotation of the second date correction transmitting wheel 144 whereby date display is corrected.

Further, by rotating the winding stem 106 in the second direction that is reverse to the first direction, the calendar correcting wheel 146 receives the rotational force of the crown wheel 190 and the calendar oscillation correcting lever 148 is oscillated in the second direction that is reverse to the first direction and rotates a first day correction transmitting wheel (not illustrated) and a second day correction transmitting wheel 180. By rotation of the second day correction transmitting wheel 180, the intermediate day wheel driving gear 158 is rotated whereby day display is corrected.

Next, in correcting time, the winding stem 106 is further drawn to the 2-th stage. In this case, a small hour hand corrector setting lever (not illustrated) is further rotated. A locking bar 310 is rotated in a direction reverse to the above-described rotation by the spring force of the locking bar and makes the teeth 118*a* of the clutch wheel 118 in mesh with the setting wheel 120. When the winding stem 106 is rotated under this state, the clutch wheel tooth 118 is rotated and the cannon pinion 128 and the hour wheel 112 is rotated by rotation of the minute wheel and gear 110 via rotation of the setting wheel 120 thereby correcting time display.

(10) Operation of Winding Up Power Spring

When the multi-functional timepiece of the present invention is constituted by a mechanical watch, in the state where the winding stem 106 is at the 0-the stage, when the winding stem 106 is rotated, the winding pinion 192 and the crown wheel 190 are rotated by rotation of the teeth 112*b* of the crutch wheel 118. The crown wheel 190 is in mesh with the sliding crown wheel 196. The sliding crown wheel 196 is idled in a range of a predetermined angle.

When the crown wheel 190 is rotated in one direction, the square hole wheel 198 is rotated via rotation of the sliding crown wheel 196 whereby the power spring is wound up.

When the crown wheel 190 is rotated in other direction, although rotation of the crown wheel 190 idles the sliding crown wheel 196, the sliding crown wheel 196 does not rotate the square hole wheel 198.

As a result, the square hole wheel 198 is rotated always in one direction by the crown wheel 190.

Accordingly, the power spring can firmly be wound up by the rotation of the winding stem 106 in one direction. The rotation of the winding stem 106 in other direction does not wind up the power spring.

Next, in correcting calendar time, the winding stem 106 is further drawn to the 1-th stage. In this case, similar to the above-described operation, the power spring can be wound up by rotation of the square hole wheel 198 via rotation of the clutch wheel 118, the winding pinion 192, the crown wheel 190 and the sliding crown wheel 196 by rotation of the winding stem 106 in one direction. Rotation of the winding stem 106 in other direction does not wind up the power spring.

(11) Constitution of Time Correcting Portion

Next, an explanation will be given of the constitution of the time correcting portion in the embodiment of the multi-functional timepiece according to the present invention.

Referring to FIG. 1 through FIG. 6, the movement (mechanical body) 100 of the multi-functional timepiece of the present invention is provided with the main plate 102 and the auxiliary plate 104.

Referring to FIG. 1, FIG. 12, FIG. 13 and FIG. 14, a small hour corrector winding stem 410 is integrated to the main plate 102. A small hour hand corrector clutch wheel 412 is integrated to the small hour corrector winding stem 410. A small hour hand correcting wheel 414 is integrated between the main plate 102 and the auxiliary plate 104.

A small hour hand corrector setting lever 416 is oscillatably integrated to the main plate 102. A portion of the small hour hand corrector setting lever 416 is engaged with the small hour corrector winding stem 410. A time correction locking bar 418 is oscillatably integrated to the main plate 102. A portion of the time correction locking bar 416 is engaged with the small hour hand corrector clutch wheel 412. A portion of the small hour hand corrector setting lever 416 is engaged with a portion of the time correcting locking bar 416.

A small hour hand corrector lever 420 is integrated to the small hour hand corrector setting lever 416. A long hole 420*a* of the small hour hand corrector lever 420 is engaged with an intermediate small hour corrector wheel and pinion stem of an intermediate small hour corrector wheel and pinion 422. That is, the long hole 420*a* of the small hour hand corrector lever 420 is constituted to fit to the position of the intermediate small hour corrector wheel and pinion stem 422*a* in the diameter and height directions. By this constitution, the small hour hand corrector lever 420 can firmly be guided. Further, by the constitution, a number of parts with respect to the time correcting portion can be reduced and a time period of integration can also be reduced.

The intermediate small hour corrector wheel and pinion 422 is provided with an intermediate small hour corrector gear 424 and an intermediate small hour corrector pinion 426. The intermediate small hour corrector pinion 426 is in mesh with the day indicator driving wheel gear 152.

The small hour hand corrector lever 420 is constituted to be engaged with the hammer 182 when the time correction state is produced by drawing the small hour corrector winding stem 410. Under this state, the hammer 182 is constituted to dispose at the external side of the portion of the operating cam 170 where the outer diameter is maximized. Accordingly, operation of time difference correction can be performed irrespective of the position of the operating cam 170. Further, operation of parts are stabilized and unnecessary force is not applied on parts in the operation.

(12) Operation of Multi-functional Timepiece of the Present Invention Having Time Correcting Portion Here, an explanation will be given of operation of the embodiment of the multi-functional timepiece of the present invention having a time correcting portion. The multi-functional timepiece of the present invention having the time correcting portion may a mechanical watch, an electronic watch or an electric watch.

In the case of the mechanical watch, as mentioned above, referring to FIG. 4, FIG. 12, FIG. 13 and FIG. 15, according to the multi-functional mechanical watch of the present invention, rotation of the complete barrel with main spring 108 rotates the fourth wheel and pinion 131 via the center wheel and pinion 126 and the third wheel and pinion 256. The third wheel and pinion 256 rotates the second wheel pinion 130.

The cannon pinion 128 is rotated by rotation of the center wheel and pinion 126 integrally therewith. The minute wheel and pinion 110 is rotated by rotation of the cannon pinion 128. The hour wheel 112 is rotated by the minute wheel and pinion 110.

Figure 13:
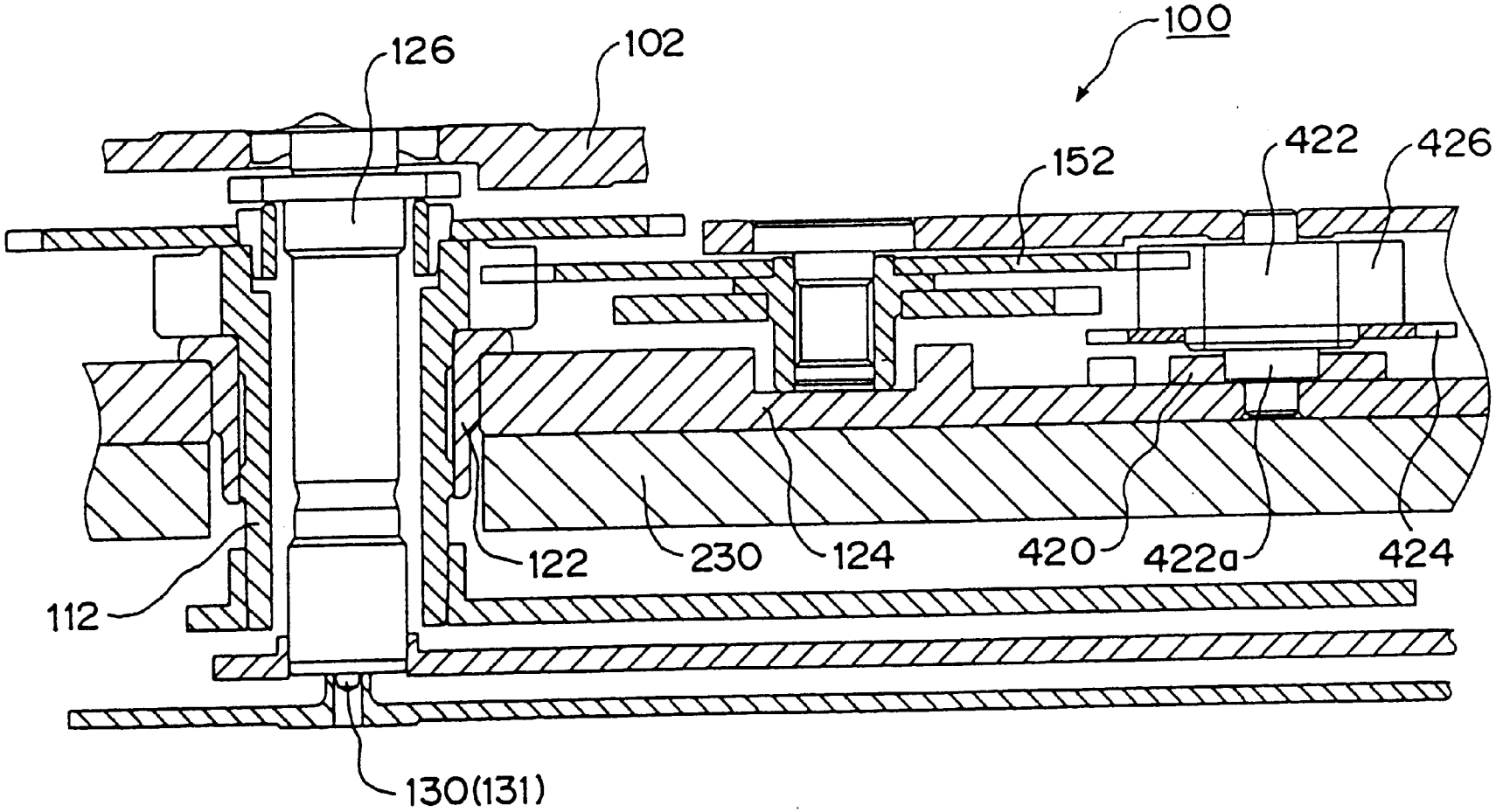
FIG. 13 is a second partial sectional view showing a time correcting portion according to the embodiment of the multi-functional timepiece of the present invention.
Figure 14:
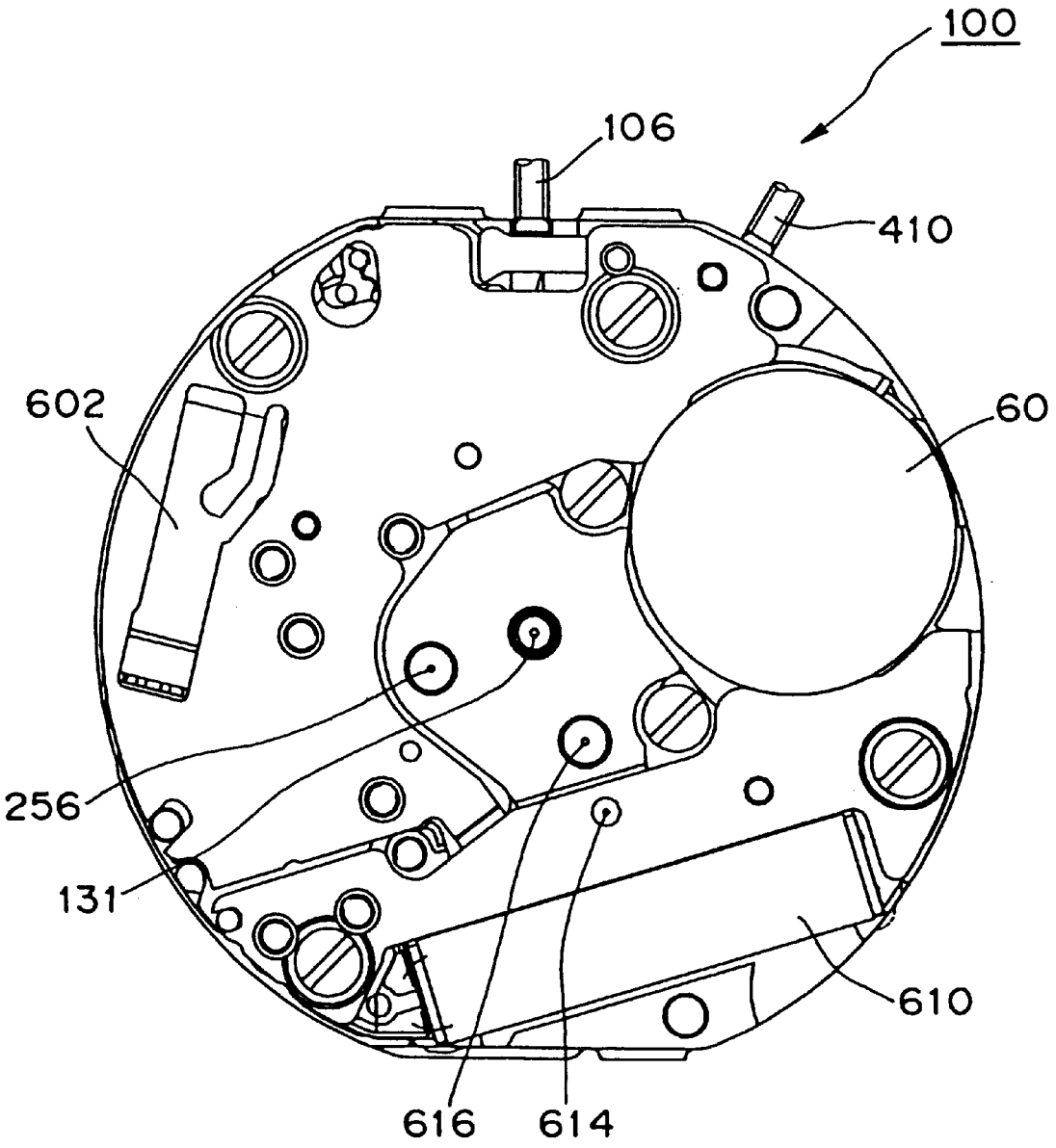
FIG. 14 is an outline plane view showing a structure of an obverse side portion according to an embodiment of a multi-functional electronic timepiece of the present invention.

In the case of a mechanical watch, in FIG. 13, the second hand 136 is attached to the second wheel pinion 130. Such a constitution of wheel train is advantageous in realizing a thin watch.

Further, in the case of a mechanical watch, instead of providing the second wheel pinion 130, a constitution of wheel train where the fourth wheel and pinion 131 penetrates the center hole of the center wheel and pinion 126. In this case, the second hand 236 is attached to the fourth wheel and pinion 131.

Further, the constitution of the wheel train of the multi-functional mechanical watch of the present invention is not limited to the above-described constitution but the constitution of wheel train in respect of the present invention may be constituted by wheel trains having any shape, number and dimensions capable of achieving a constitution in compliance with the object of the present invention.

By contrast, in the case of an electronic watch, referring to FIG. 12, FIG. 13, FIG. 14 and FIG. 16, an oscillation circuit 604 according to the embodiment of the multi-functional timepiece of the present invention is operated by a battery 600. A crystal oscillator 602 constitutes source oscillation, oscillates at, for example, 32,768 Hertz and outputs a reference signal to the oscillation circuit 604. A frequency divided circuit 606 performs predetermined frequency dividing operation by inputting an output signal from the oscillation circuit 604 and outputs, for example, a signal of 1 Hertz. A driving circuit 608 inputs an output signal from the frequency divided circuit 606 and outputs a predetermined drive signal for driving a stepping motor.

A coil block 610 inputs the predetermined drive signal for driving a stepping motor and magnetizes a plurality of poles of a stator 612. A rotor 614 is rotated by the magnetic force of the stator 612. The rotor 614 is rotated by 180° per second based on the above-described signal of 1 Hertz. A fifth wheel and pinion 616 is rotated by rotation of the rotor 614. The fourth wheel and pinion 131 is rotated by 6° per second by rotation of the fifth wheel and pinion 616. The third wheel and pinion 256 is rotated by rotation of the fourth wheel and pinion 131. The center wheel and pinion 126 is rotated by rotation of the third wheel and pinion 256. The minute wheel and pinion 110 is rotated by the center wheel and pinion 126.

In the case of the electronic watch, a second wheel pinion is not provided. In this case, in FIG. 13, the second hand 236 is attached to the fourth wheel and pinion 131.

In the case of the electronic watch, similar to the above-described constitution of the mechanical watch, a second wheel pinion may be provided and a second hand may be attached to the second wheel pinion.

Further, the constitution of wheel train of the multi-functional electronic watch of the present invention is not limited to the above-described constitution but the constitution of wheel train according to the present invention may be constituted by wheel trains having any shape, number and dimensions capable of achieving a structure in compliance with the object of the present invention.

An indicator construction part 121 includes a wheel train and a display member for calendar display, a wheel train for 24 hour display, a display member, a member for correction and the like. The operation of indicator construction part 121 is the same as the operation of the above-described embodiment of the present invention.

The operation of the indictor construction part 121 by rotation of the hour wheel gear 112 and the intermediate date driving wheel and pinion 117 is the same as the operation of the above-described embodiment of the present invention.

Next, when a user performs operation of time difference correction, the user draws the small hour corrector winding stem 410 to the 1-th stage. In this case, the small hour hand corrector setting lever 416 is rotated. The time correction locking bar 418 makes the small hour hand corrector clutch wheel teeth 412*a* of the small hour hand corrector clutch wheel 412 in mesh with the small hour hand corrector setting wheel 414 by the spring force of the locking bar.

When the small hour corrector winding stem 410 is rotated under this state, the small hour hand corrector clutch wheel 412 is rotated and the intermediate small hour corrector wheel and pinion 422 is corrected via rotation of the small hour hand corrector setting wheel 414. The day indicator driving wheel gear 152 is rotated by rotation of the intermediate small hour corrector wheel and pinion 422. The intermediate date driving wheel and pinion 117 is rotated by rotation of the day indicator driving wheel gear 152. In this case, the hour wheel gear 114 is not rotated integrally with the intermediate date driving wheel and pinion 117 owing to the spring action of the time jumper pinion.

Accordingly, the hour hand 232 can be rotated by a unit of 1 hour by rotation of the small hour corrector winding stem 410. The hour hand 232 can be rotated both in the clockwise direction and the anticlockwise direction. Further, the date driving wheel gear 132 is also rotated by rotation of the intermediate date driving wheel and pinion 117. As a result, date driving and day driving can be performed in cooperation with time correction. Further, the date driving and day driving can be performed both in advancing direction and returning direction.

The small hour hand corrector lever 420 is moved by operation of the small hour hand corrector setting lever 416. The long hole of the small hour hand corrector lever 420 is guided by the intermediate small hour corrector wheel and pinion stem 422*a*. The small hour hand corrector lever 420 rotates the hammer 182. The hammer 182 rotates the small day wheel 184. As a result, the day hand 240 indicates a separate portion different from display of day of week.

(13) Detailed Explanation of Operation of Time Correcting Portion

Next, a detailed explanation will be given of the operation of the time correcting portion according to the embodiment of the multi-functional timepiece of the present invention.

Figure 17:
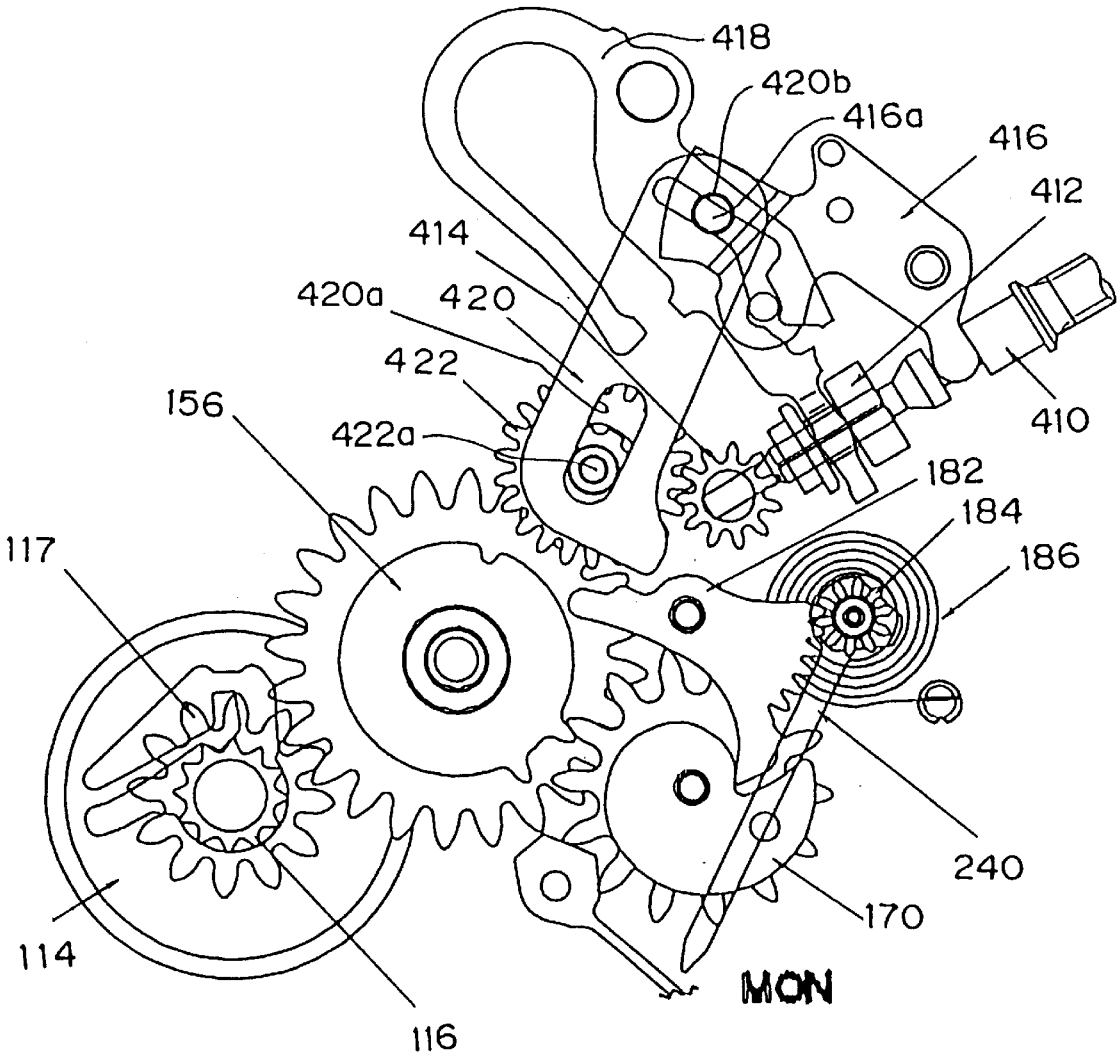
FIG. 17 is an outline partial plane view showing a state where a small hour corrector winding stem is set to a 0-th stage when the day of week is Monday according to the embodiment of a multi-functional timepiece of the present invention.

Referring to FIG. 17, when time difference correction is not performed, the small hour hand corrector winding stem 412 is disposed at the 0-th stage. In this case, the small hour hand corrector clutch wheel teeth 412*a* of the small hour hand corrector clutch wheel 412 is not in mesh with the small hour hand corrector setting wheel 414. A circular hole 420*b* of the small hour hand corrector lever 420 is integrated to a pin 416 of the small hour hand corrector setting lever 416. A long hole 420*a* of the small hour hand corrector lever 420 is integrated to the intermediate small hour corrector wheel and pinion stem 420*a*. The small hour hand corrector lever 420 is not brought into contact with the hammer 182. The day hand 240 indicates one of seven days of week, for example, the letter "MON" showing Monday.

Figure 18:
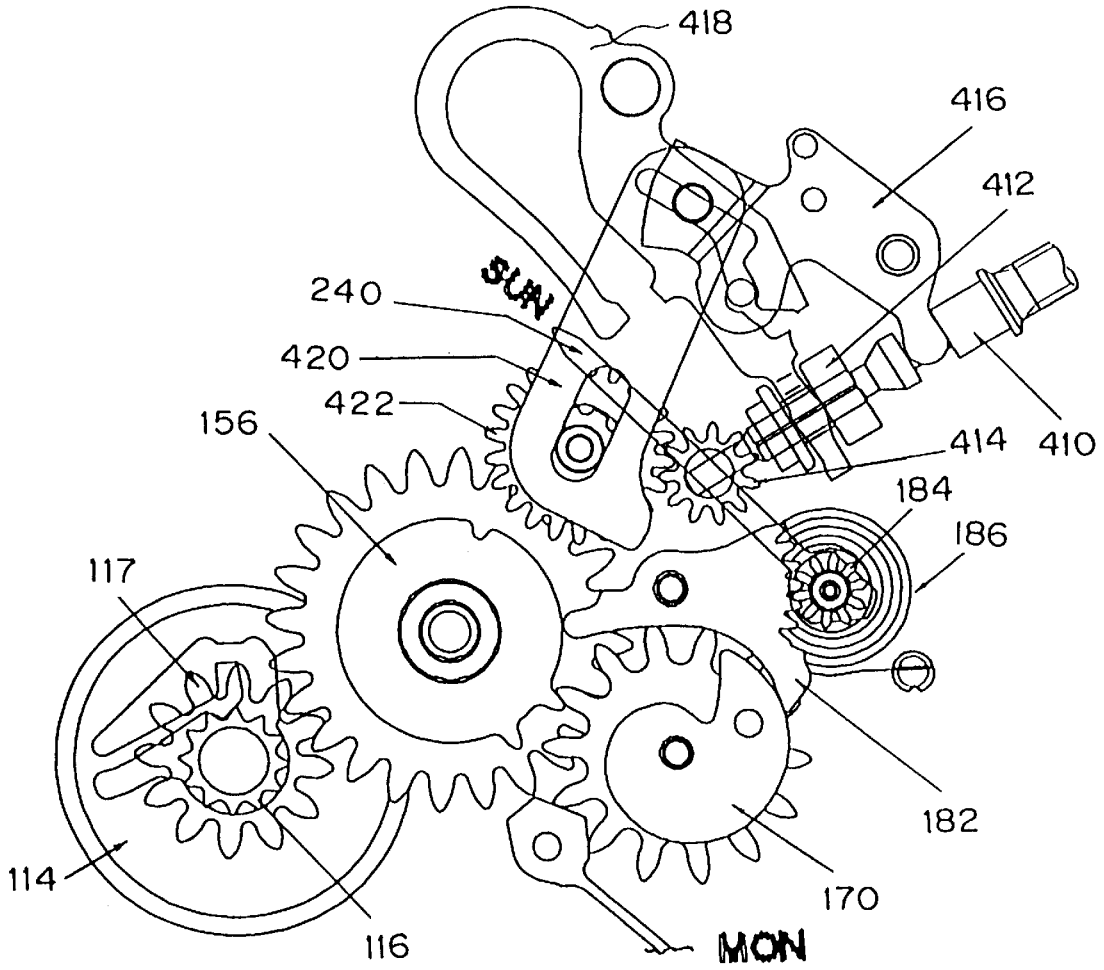
FIG. 18 is an outline partial plane view showing a state where the small hour corrector winding stem is set to the 0-th stage when the day of week is Sunday according to the embodiment of the multi-functional timepiece of the present invention.

Referring to FIG. 18, the small hour corrector winding stem 410 is disposed at the 0-th stage in the case of Sunday where time correction is not performed. In this case, the day hand 240 indicates, for example, the letter "SUN" showing Sunday.

Next, an explanation will be given to the operation when time correction is performed.

Figure 19:
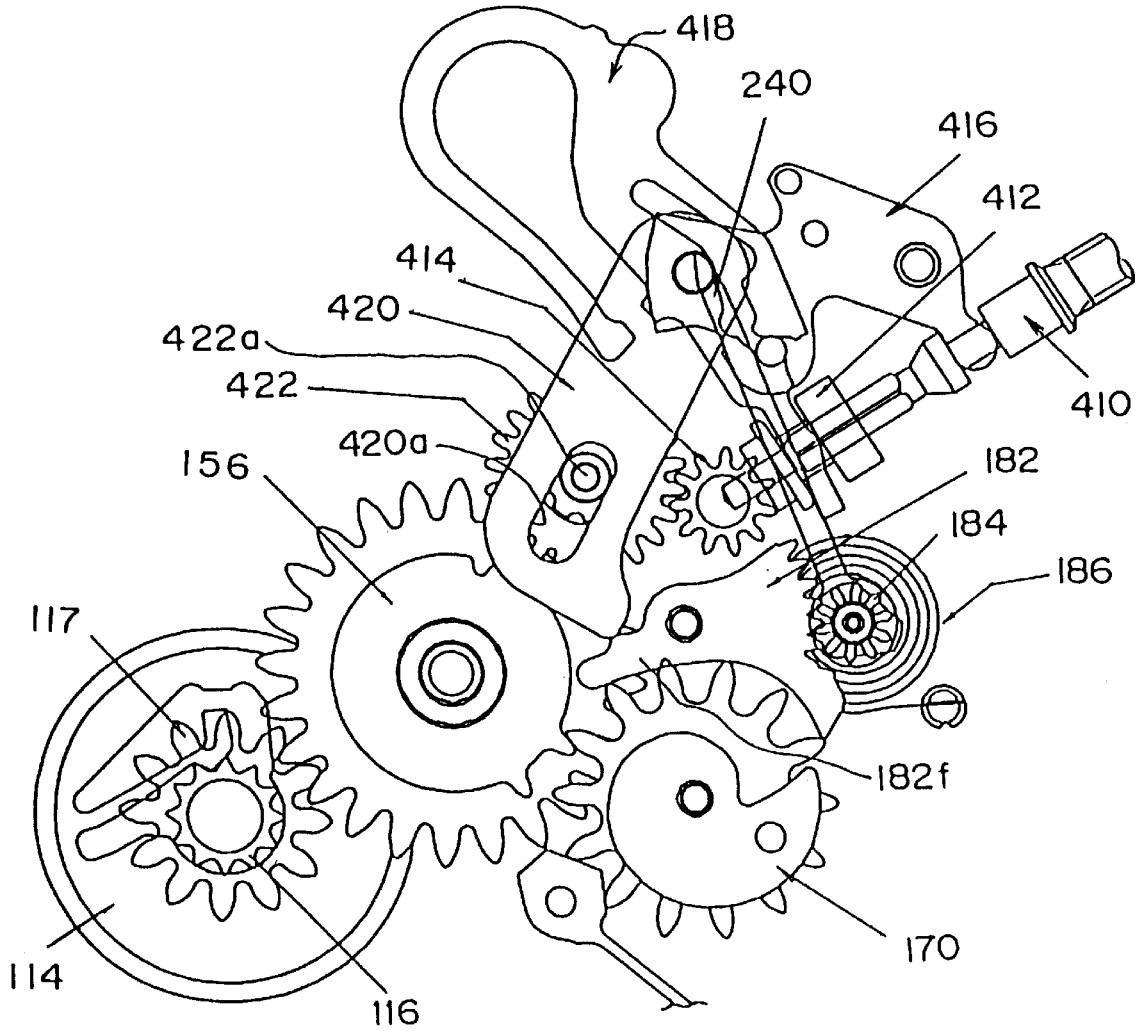
FIG. 19 is an outline partial plane view showing a state where the small hour corrector winding stem is set to the 1-th stage according to the embodiment of the multi-functional timepiece of the present invention.

Referring to FIG. 19, the small hour corrector winding stem 410 is drawn to dispose at the 1-th stage when time correction is performed. In this case, the small hour hand corrector clutch wheel teeth 412*a* of the small hour hand corrector clutch wheel 412 is in mesh with the small hour hand corrector setting wheel 414.

The small hour hand corrector lever 420 is moved by being guided by the intermediate small hour corrector wheel and pinion stem 420*a* by the operation of the small hour hand corrector setting lever 416. The small hour hand corrector lever 420 pushes a tail portion 182*f* of the hammer 182. The hammer 182 is rotated in the anticlockwise direction. The hammer 182 is brought into a state of noncontacting the operating cam 170. The small day wheel 184 is rotated in the clockwise direction by the hammer 182.

The day hand 240 indicates portions different from display of seven days of week. Accordingly, the day hand 240 indicates that the small hour corrector winding stem 410 for performing time difference correction is drawn.

When operation of time difference correction is finished, the small hour corrector winding stem 410 is pushed to return to the 0-th stage. Then, as shown by FIG. 17, the small hour hand corrector clutch wheel teeth 412*a* of the small hour hand corrector clutch wheel 412 is not in mesh with the small hour hand corrector setting wheel 414. The small hour hand corrector lever 420 is not brought into contact with the hammer 182. As a result, the day hand 240 returns to the original display state and indicates again the letter "MON" showing Monday.

It is preferable that the multi-functional timepiece of the present invention is provided with time display in the 24 hour system along with the time correcting portion. In this case, the multi-functional timepiece provided with the time display in the 24 hour system along with the time correcting portion of the present invention, may be provided with a date display portion and/or a day display portion or may not be provided with the date display portion and/or the day display portion.

Figure 15:
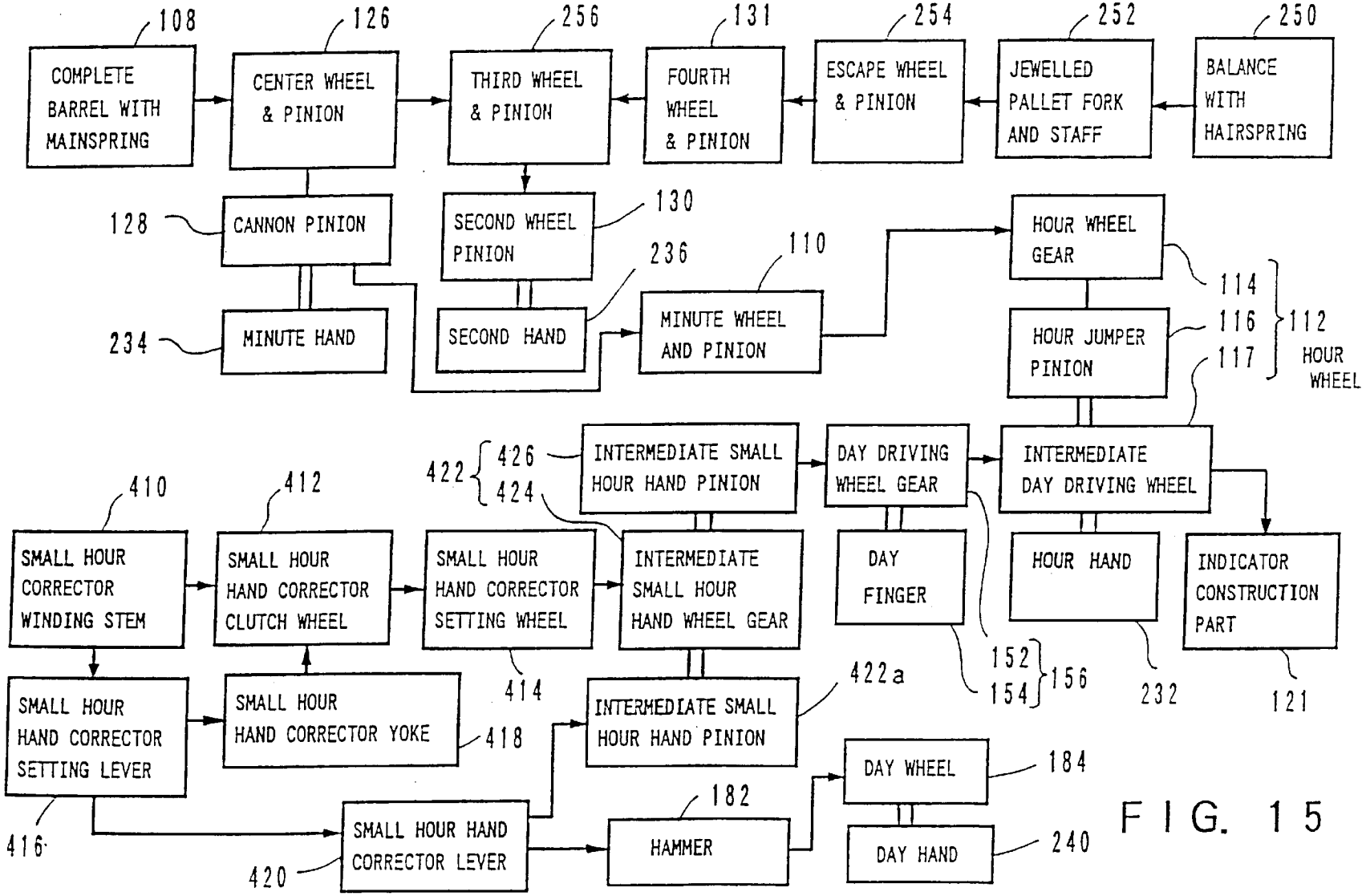
FIG. 15 is an outline block diagram showing an embodiment of a multi-functional mechanical timepiece of the present invention.
Figure 16:
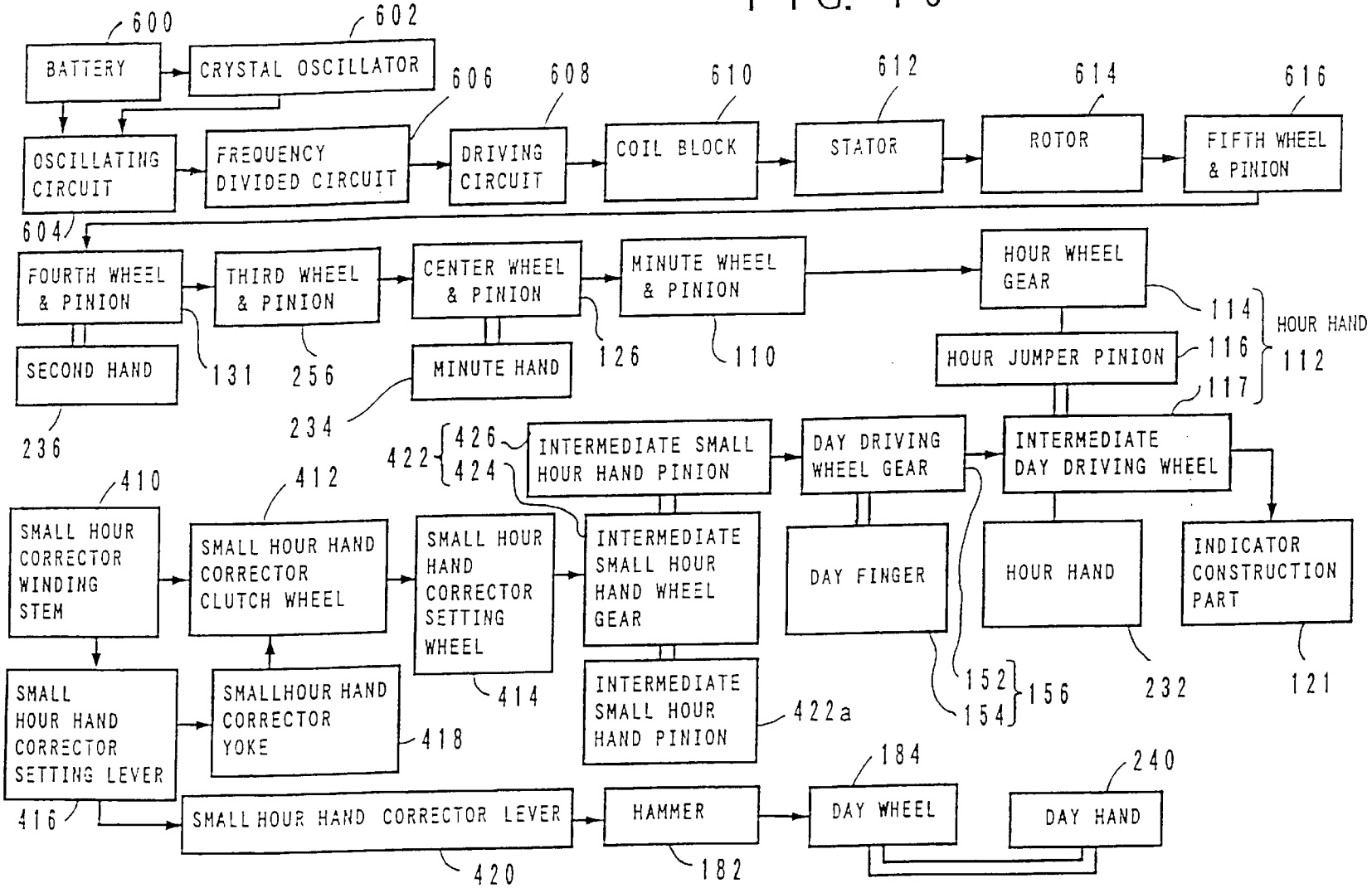
FIG. 16 is an outline block diagram showing an embodiment of a multi-functional electronic timepiece of the present invention.

According to the constitution shown by FIG. 15 and FIG. 16, the multi-functional timepiece of the present invention which does not have a day display portion may be of a constitution where the day finger 154 is not included. Further, in this case, according to the constitution shown by FIG. 15 and FIG. 16, it is preferable that the day indicator driving wheel gear 152 is preferably referred to as a time correction transmitting gear. Because when the day display portion is not provided, the name in accordance with the function of the gear is not "day driving" but it is appropriate that the gear is referred to as "time correction transmitting" based on the essential function.

(14) Constitution of Wheel Train for Transmitting Rotation of Timepiece

Figure 20:
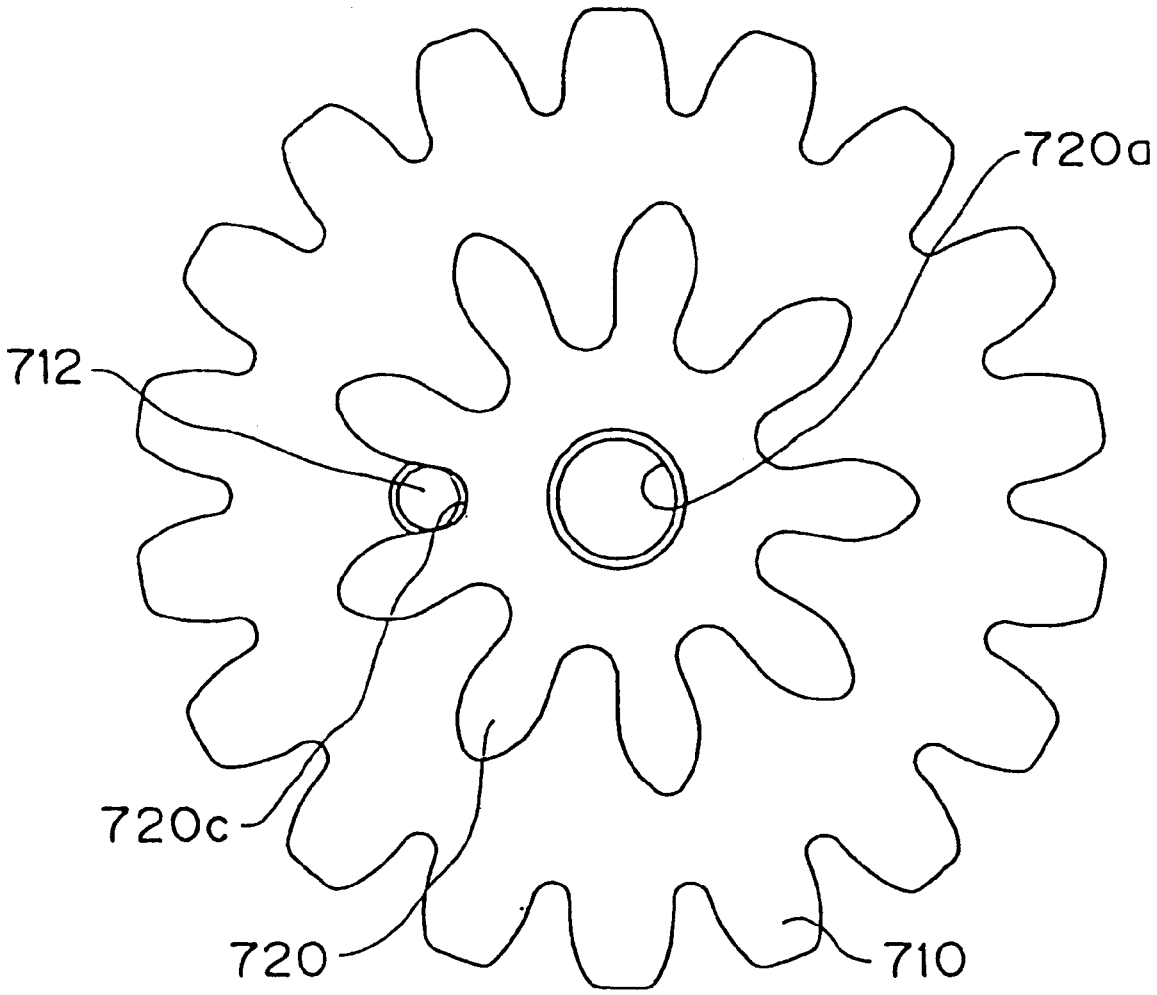
FIG. 20 is an outline plane view showing an embodiment of a wheel train member for transmitting rotation of timepiece according to the present invention.
Figure 21:
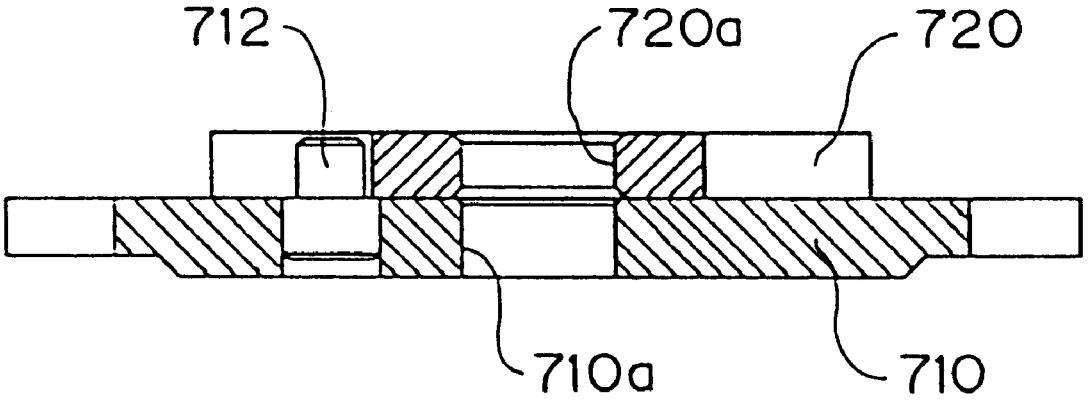
FIG. 21 is an outline sectional view showing the embodiment of the wheel train member for transmitting rotation of timepiece according to the present invention.

Referring to FIG. 20 and FIG. 21, the wheel train member for transmitting rotation of timepiece includes two gears. A first gear 710 is provided with a center hole 710*a*. A guide pin 712 is fixed to the first gear 710. A second gear 720 is provided with a center hole 720*a*.

The position of the guide pin 712 is determined such that when the center hole 710*a* of the first gear 710 is aligned with the center hole 720*a* of the second gear 720, the outer peripheral portion of the guide pin 712 is brought into contact with a vicinity of a tooth bottom portion 720*c* of the second gear 720.

The first gear 710 and the second gear 720 is integrated into one part in using them. In this case, the center hole 710*a* of the first gear 710 is aligned with the center hole 720*a* of the second gear 720.

As a result, the first gear 710 and the second gear 720 are rotated integrally. That is, when one of the gears is rotated, the other one of the gears are rotated simultaneously with the same speed and in the same rotational direction.

By this constitution, it is not necessary to strikingly fix the two gears. Accordingly, manufacturing and integration of parts are much facilitated.

The position of providing the guide pin 712 is set to a portion where no malfunction is caused in operating the first gear 710 and operating the second gear 720. That is, it is preferable that the position of providing the guide pin 712 is proximate to the center hole 720*a*.

Such a wheel train member for transmitting rotation of timepiece is applicable to the day correcting portion of the embodiment of the present invention. That is, it is preferable that the structure of the above-described second gear 720 is applied to the first day correction transmitting wheel and the structure of the above-described first gear 710 is applied to the second day correction transmitting wheel 180.

By the structure, the wheel train member for transmitting rotation of timepiece that is easy to manufacture is provided.

(15) Second Structure of Calendar Portion

The constitution of the rear side of the multi-functional timepiece of the present invention is not limited to the constitution shown by FIG. 1.

Figure 22:
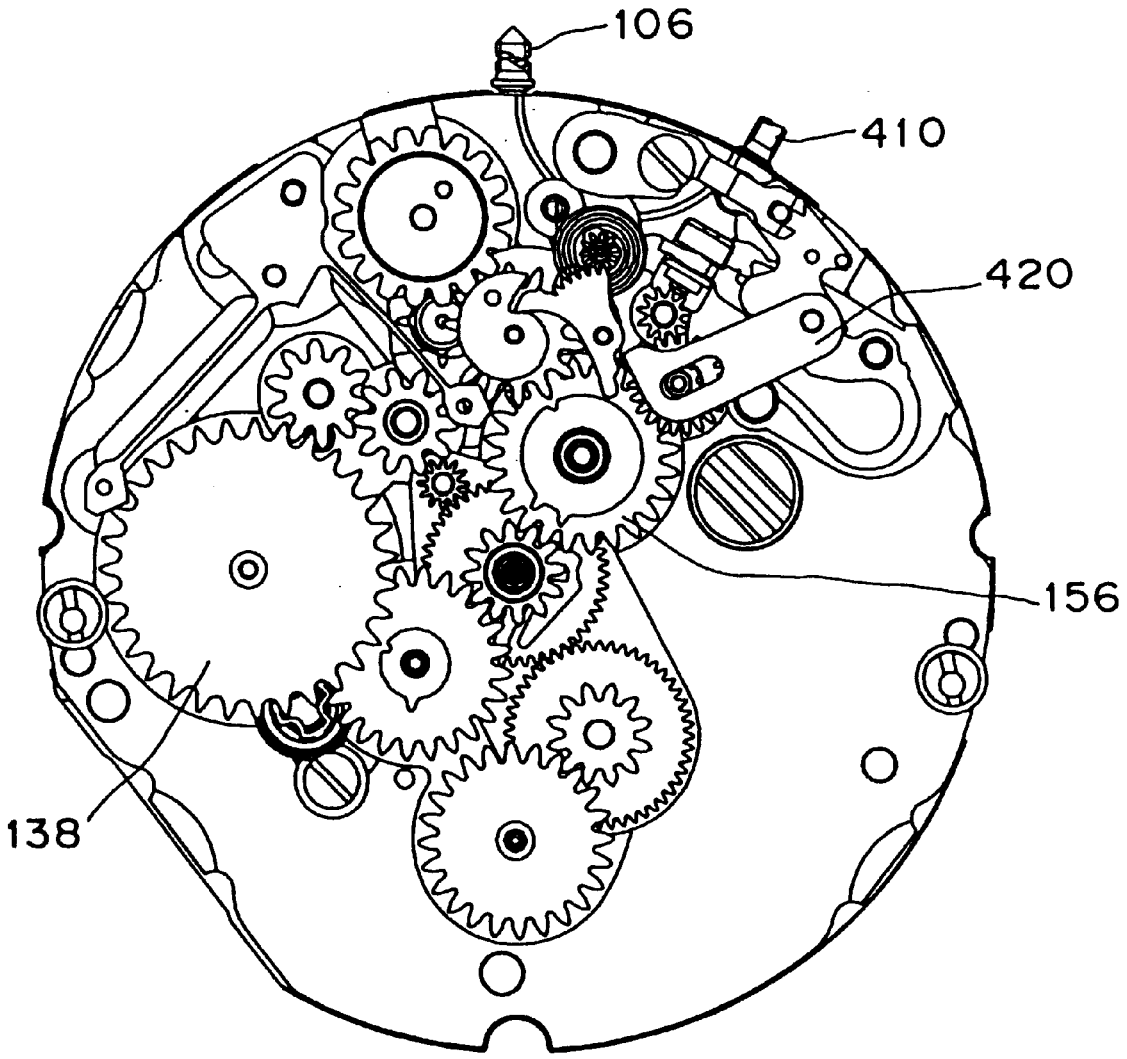
FIG. 22 is an outline plane view showing a second structure of a calendar portion according to an embodiment of a multi-functional timepiece of the present invention.

Referring to FIG. 22, the winding stem 106 is integrated in the 3 o'clock direction of timepiece. The small hour corrector winding stem 410 is integrated in the substantially 4 o'clock direction of timepiece.

According to the embodiment having the second structure of calendar portion of the multi-functional timepiece of the present invention, the arrangement of the respective parts such as the respective parts 138, 156 and the like constituting the calendar portion and the respective parts 120 and the like constituting the time correcting portion, is in mirror symmetry with the arrangement of the above-described embodiment shown by FIG. 1 of the present invention with the center axis line of the winding stem 106 as a reference. Similarly, also the arrangement of the respective parts disposed on the obverse side of the timepiece is in mirror symmetry with the arrangement of the above-described embodiment shown by FIG. 1 of the present invention with the center axis line of the winding stem 106 as a reference.

The rotational center of the day hand 240 is disposed substantially between the 3 o'clock direction and 4 o'clock direction of timepiece. The rotational center of the date hand 238 is disposed substantially in the 12 o'clock direction of timepiece. The rotational center of the 24 hour hand is disposed substantially in the 9 o'clock direction of timepiece.

In this case, the rotational direction of the driving portion, a number of gears constituting the wheel train portion and the like are selected such that the hour hand, the minute hand, the second hand, the 24 hour hand and the day hand are rotated in the clockwise direction.

Further, in this case, the rotational direction of the driving portion, a number of gears constituting the wheel train portion and the like may be selected such that at least one of a combination of the hour hand, the minute hand and the second hand, the 24 hour hand and the day hand is rotated in the anticlockwise direction. By this constitution, the multi-functional timepiece having a novel display portion can be realized.

By the constitution, a multi-functional timepiece where the small hour corrector winding stem 410 is disposed substantially at the 4 o'clock direction can be realized. Therefore, according to the present invention, a timepiece where the small hour corrector winding stem 410 is disposed substantially in the 2 o'clock direction can be realized and a timepiece where the small hour corrector winding stem 410 is disposed substantially in the 4 o'clock direction can also be realized in accordance with the necessity of a user.

(16) Explanation of Outlook of Timepiece

Figure 23:
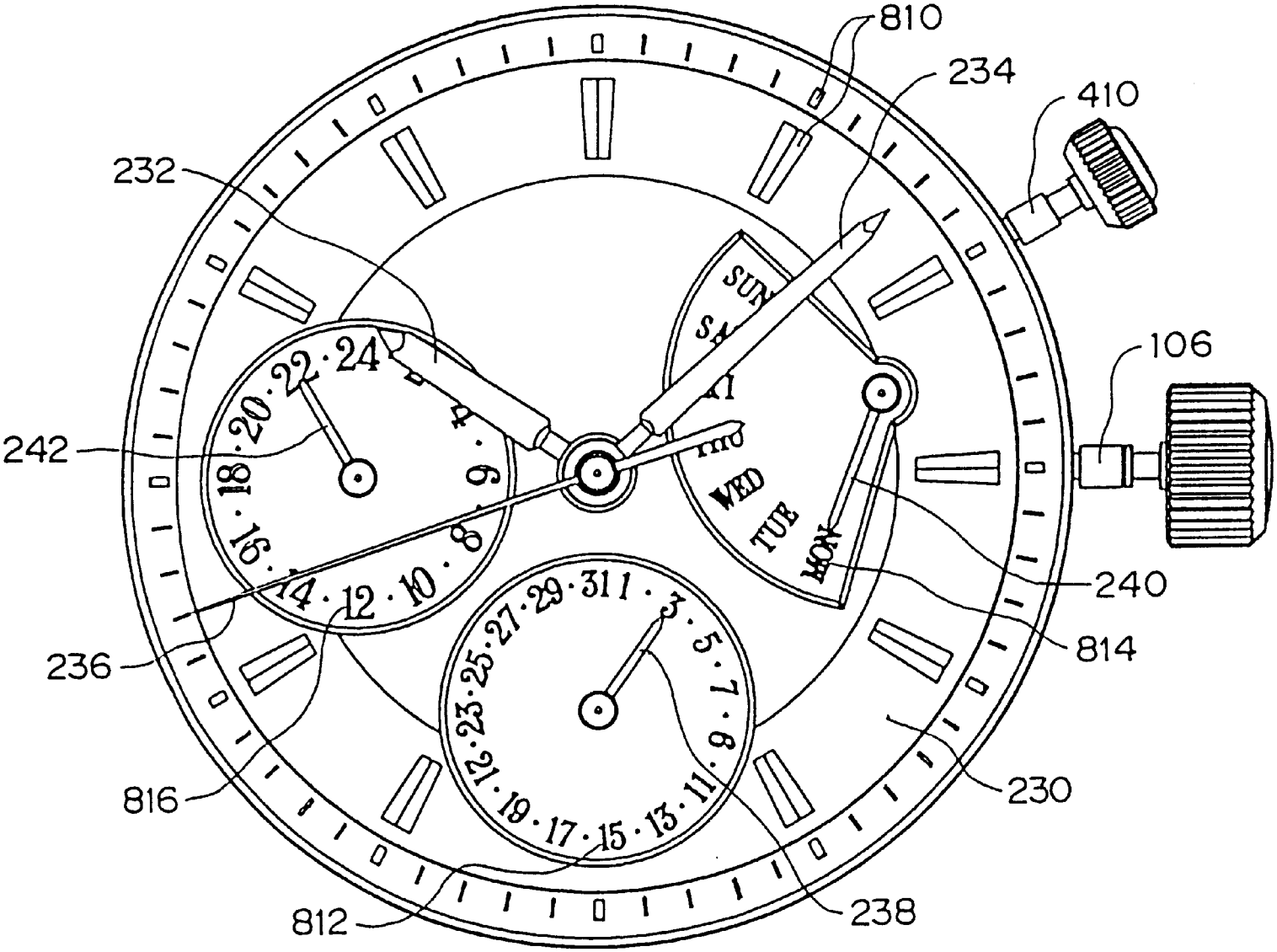
FIG. 23 is an outline plane view showing an outlook when the day of week is Monday according to the embodiment of the multi-functional timepiece of the present invention.

An explanation will be given of the structure of a complete display portion (wrist watch having case) of a multi-functional wrist watch of the present invention. Referring to FIG. 23, the winding stem 106 of this multi-functional timepiece is positioned at the 0-th stage. Also, the small hour corrector winding stem 410 is positioned at the 0-th stage. Under this state, the date correction, the day correction, the time adjustment and the time difference correction cannot be performed. In this state, the power spring can be wound up.

A time display portion 810, a date display portion 812, a day display portion 814 and a 24 hour display portion 816 are provided on the dial 230.

The time display portion 810 showing time in the 12 hour system is provided, for example, along the outer periphery of the dial 230.

The center of the day display portion 812 is provided substantially in the 6 o'clock direction of timepiece. All of numerals of from 1 through 31, or predetermined numerals between 1 through 31 are provided along the outer periphery of the day display portion 812. According to a structure shown by FIG. 24, numerals showing odd numbers between 1 through 31, or, 1, 3, . . . 27, 29, 31 are provided.

The center of the 24 hour display portion 816 indicating time in the 24 hour system is provided substantially in the 9 o'clock direction of timepiece. All of numerals of 1 through 24 or predetermined numerals between 1 through 24 are provided along the outer periphery of the 24 hour display portion 816. According to a structure shown by FIG. 24, numerals indicating even numbers of 2 through 24, or, 4, 6, . . . 20, 22, 24 are provided.

The day display portion 814 is provided substantially between the 2 o'clock direction and the 3 o'clock direction of timepiece. Letters or notations showing seven days of week are provided along the outer periphery of the day display portion 814. According to a structure shown by FIG. 24, English letter of MON, TUE, WED, THU, FRI, SAT and SUN are provided. Letters indicating seven days of week may be designated by Chinese letters of Monday, Tuesday, Wednesday, Thursday, Friday, Saturday and Sunday or may be Roman letters of I, II, III and the like or letters of other national language.

Further, a plurality of kinds of letters or notations, for example, "MON: Monday (Chinese letter)", "TUE: Tuesday (Chinese letter)" . . . "SUN: Sunday (Chinese letter)" and like may be provided. By such constitutions, one multi-functional timepiece can be used in many countries. The above-described multi-functional timepiece having a plurality of kinds of letters, can be used both in countries using English and the country using Japanese.

The present time can be read by the positional relationships among the hour hand 232, the minute hand 234 and the second hand 236 and the time display portion 810.

The date of today can be read by the positional relationship between the day hand 238 and the day display portion 812.

The day of today can be read by the positional relationship between the day hand 240 and the day display portion 814.

The present time in the 24 hour system can be read by the positional relationship between the 24 hour hand 242 and the 24 hour display portion 816.

The multi-functional timepiece shown by FIG. 23 displays "3rd date", "Monday", "10 o'clock 8 minutes 42 seconds", "22 hour (10 o'clock pm)".

Figure 24:
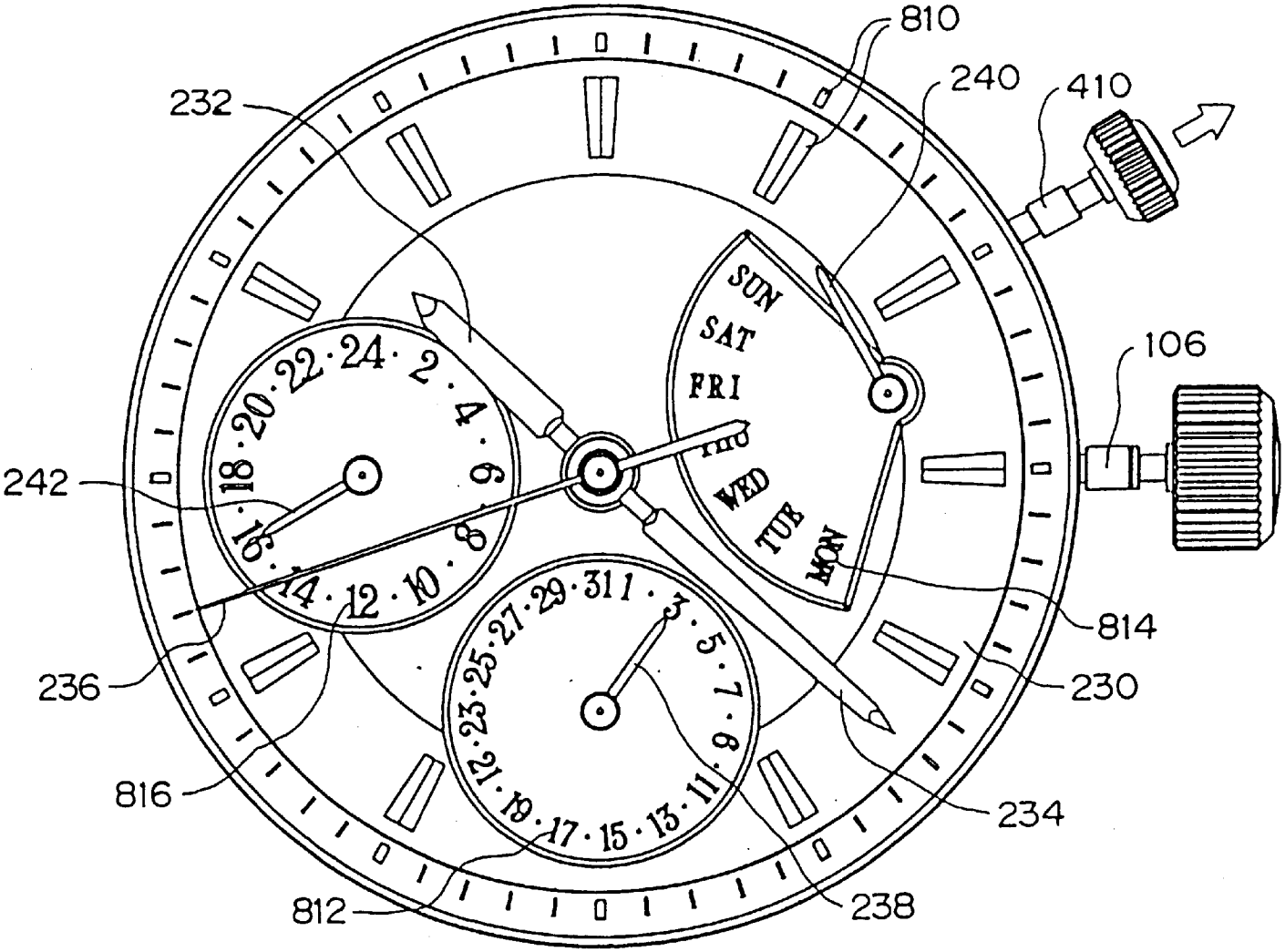
FIG. 24 is an outline plane view showing an outlook in a state where time difference correction is performed according to the embodiment of the multi-functional timepiece of the present invention.

Referring to FIG. 24, the multi-functional timepiece is in a state where correction of time difference can be performed.

The small hour hand corrector winding stem 410 is drawn in a direction shown by an arrow mark of figure and is disposed at the 1-th stage. The current time can be read by the positional relationships among the hour hand 232, the minute hand 234 and the second hand 236 and the time display portion 810.

The date of today can be read by the positional relationship between the date hand 238 and the date display portion 812.

The present time in the 24 hour system can be read by the positional relationship between the 24 hour hand 242 and the 24 hour display portion 816.

The week hand 240 indicates the outside of the range of the day display portion 814. Thereby, it is known that the multi-functional timepiece is in a state capable of performing correction of time difference.

When the small hour corrector winding stem 410 is pushed to the 0-th stage, the day hand 240 indicates a letter in the day display portion 814. Therefore, the day of today can be read by the positional relationship between the day hand 240 and the day display portion 814.

Next, an explanation will be given of the case where the multi-functional timepiece of the present invention is used as a dual time display watch.

Figure 25:
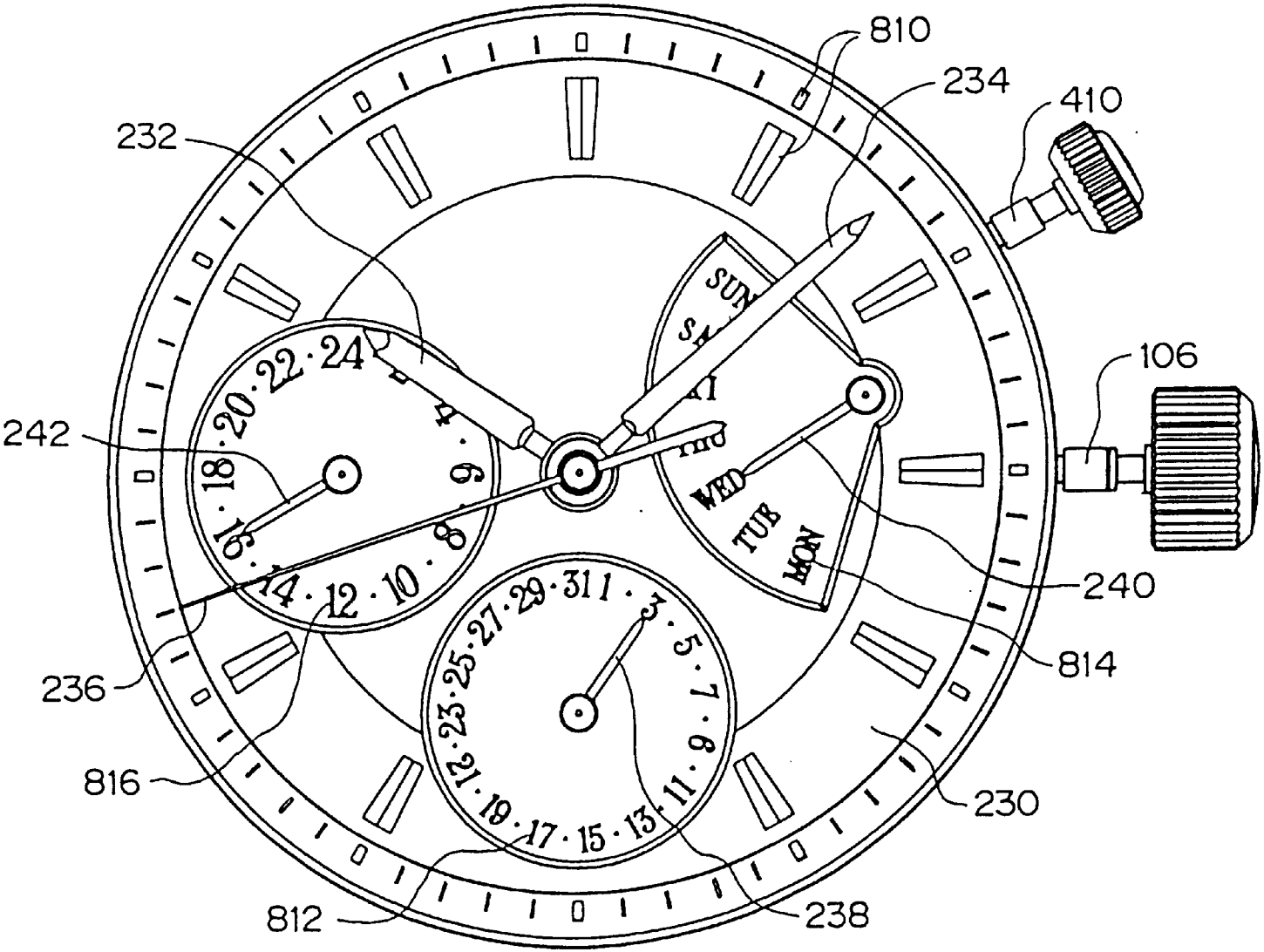
FIG. 25 is an outline plane view showing an outlook in a state where the multi-functional timepiece is used as a dual time timepiece according to the embodiment of the multi-functional timepiece of the present invention.

Referring to FIG. 25, the winding stem 106 is disposed at the 0-th stage. The small hour corrector winding stem 410 is also disposed at the 0-th stage. In this state, the time difference correction cannot be performed.

The multi-functional timepiece shown by FIG. 25 is in the state where timepiece has already been operated to correct time difference. That is, it is in the state where the time hand 232 has been rotated by operating the small hour collector winding stem 410. Such an operation is needed when both of the actual place time (local time) and the mother country time (home time) are intended to simultaneously be known in overseas travelling or the like.

For example, the current time at the actual place can be read by the positional relationships among the time hand 232, the minute hand 234 and the second hand 236 and the time display portion 810.

The date of today at the actual place can be read by the positional relationship between the date hand 238 and the date display portion 812. The day of today at the actual place can be read by the positional relationship between the day hand 240 and the day display portion 814. The time of mother country in the 24 hour system can be read by the positional relationship between the 24 hour hand 242 and the 24 hour display portion 816.

The multi-functional timepiece shown by FIG. 23 displays that the time at the actual place is "3rd date", "Wednesday", "10 o'clock 8 minutes 42 seconds" and at the same time displays that the time at the mother country is "16 hour (4 o'clock pm)".

In this case, the two times displayed by the multi-functional timepiece of the present invention are not limited to time at the actual place and time at the mother country but may be arbitrary two times needed by a user.

By such a constitution, times at two places can simultaneously be displayed.

Accordingly, summarizing the method of operating the multi-functional timepiece according to the present invention:

when the winding stem is disposed at the 0-th stage:
- right rotation→winding up of power spring
- left rotation→idling;

when the winding stem is disposed at the 1-th stage:
- right rotation→winding up of power spring and day correction
- left rotation→date correction;

when the winding stem is disposed at the 2-th stage:
- right rotation→time adjustment of hour hand, minute hand and secondhand and time adjustment of 24 hour hand (reverse direction hand winding, that is, hand winding in anticlockwise direction)
- left rotation→time adjustment of hour hand, minute hand and secondhand and time adjustment of 24 hour hand (regular direction hand winding, that is, hand winding in clockwise direction);

when the small hour corrector winding stem is disposed at the 0-th stage:
- right rotation→idling
- left rotation→idling;

when the small hour corrector winding stem is disposed at the 1-th stage:
- right rotation→regular direction time difference correction of hour hand
- left rotation→reverse direction time difference correction of hour hand.

Further, when time difference correction is performed with respect to the hour hand by the small hour corrector winding stem, the date driving and the day driving can simultaneously be performed. As a result, a user can always know accurate date, day of week and time.

(17) Application of Structure of the Present Invention

Although an explanation has been given of mainly embodiments of wrist watches as described above in respect of the embodiments of the multi-functional timepieces of the present invention, all the constitution of the present invention is applicable to a clock, a watch or a large-sized timepiece.

Further, all the constitution of the present invention is applicable to timepieces having all operation principles of a mechanical watch, an electric watch, an electronic watch and the like.

Further, a display device displaying information other than day of week can be achieved by using the structure of the day display portion according to the present invention. As content of display of such other display devices, there are, for example, display of months, display of year, display of six days of week, display of morning and afternoon and the like.

According to the present invention, the multi-functional timepiece is provided with the above-described constitution having the calendar portion, the time correcting portion, the dual time display portion, the wheel train portion and the like and therefore, the effect described below is achieved.

(1) A multi-functional timepiece displaying information in respect of a plurality of times, calendars or the like by a plurality of hands and having a novel outlook and shape can be realized.

(2) A display device displaying information by a hand performing a so-called fan shape rotational motion in a range of a predetermined angle can be realized.

(3) Operation of time correction of a timepiece having a time correcting portion can be stabilized and operation of parts constituting the time correcting portion can firmly be performed.

(4) Motion of hands of a timepiece having a time correcting portion is stabilized.

(5) A timepiece where a user of the timepiece can clearly recognizes a state where operation of time difference correction can be performed and a state where the operation of time difference correction cannot be performed, can be realized.

(6) Operation of integrating a date driving wheel and a day wheel is facilitated and adjustment of phases of the date driving wheel and the day wheel is easy.

(7) Guiding of a hammer can be performed by a simple structure.

(8) Display of an analog timepiece having a dual time display portion of the present invention is easy to see and easy to use.

(9) Gears which are easy to fix by adjusting phases of two of the gears and a timepiece integrated with the gears can be realized.

What is claimed is:

1. A multi-functional timepiece comprising:

a driving portion for driving the multi-functional timepiece;

a control portion for controlling operation of the driving portion;

a wheel train portion mounted for rotation based on the operation of the driving portion;

an operating cam having a cam peripheral part and mounted for rotational movement about a rotational center based on the rotation of the wheel train portion, the cam peripheral part having a radius extending from the rotational center to an outer peripheral face of the operating cam which varies continuously between a minimum value and a maximum value along the circumferential direction of the cam peripheral part;

a hammer mounted for oscillating motion by being brought into contact with the outer peripheral face of the operating cam, the operating cam being rotated based on the rotation of the wheel train portion in a direction of substantially increasing a distance between the rotational center of the operating cam to a point where the outer peripheral face of the operating cam is brought into contact with the hammer;

a day wheel mounted to undergo angular displacement in opposite directions based on the oscillating motion of the hammer; and a display member for displaying time or date information based on the angular displacement of the day wheel.

2. A multi-functional timepiece according to claim 1; further comprising an intermediate day wheel driving gear integral with the operating cam, and a day jumper for regulating rotation of the intermediate day wheel driving gear; and wherein the wheel train portion has a day finger for intermittently rotating the intermediate day wheel driving gear.

3. A multi-functional timepiece according to claim 1 or claim 2; wherein the day wheel has a day wheel spring for providing a rotational force in a direction of pressing the hammer into contact with the operating cam.

4. A multi-functional timepiece according to claim 1 or claim 2; further comprising a day indicator driving wheel mounted for rotation based on the operation of the driving portion, a date driving wheel mounted for rotation based on the operation of the driving portion, day indicator driving wheel phase adjustment means provided to the day indicator driving wheel for adjusting phases of a day indicator driving wheel gear of the day indicator driving wheel and a date driving wheel gear of the date driving wheel, and date driving wheel phase adjustment means provided to the date driving wheel for adjusting the phases of the day indicator driving wheel gear and the date driving wheel gear.

5. A multi-functional timepiece according to claim 4; wherein a difference between an angle made by a line connecting a position of a portion of the day indicator driving wheel phase adjustment means and a rotational center of the day indicator driving wheel and a line connecting a portion of the day finger and the rotational center of the day indicator driving wheel and an angle made by a line connecting a position of a portion of the date driving wheel phase adjustment means and a rotational center of the date driving wheel and a line connecting a portion of a date finger and the rotational center of the date driving wheel is 45° or less.

6. A multi-functional timepiece according to claim 1 or claim 2; further comprising an hour wheel gear mounted for rotation based on the operation of the driving portion, an hour jumper pinion integral with the hour wheel gear for rotation therewith such that a phase of rotation between the hour jumper pinion and the hour wheel gear can be changed, an hour hand for displaying time information based on the rotation of the hour jumper pinion, a time correction transmitting portion for rotating the hour jumper pinion during a time correction operation, an hour hand corrector lever for disengaging the hammer from the operating cam during the time correction operation, and a display member for displaying a time correction state of the multi-functional timepiece set by the rotation of the day wheel based on the oscillating motion of the hammer.

7. A multi-functional timepiece according to claim 6; further comprising an hour corrector winding stem for performing a time correction operation, an hour hand corrector setting lever mounted for oscillation based on movement of the hour corrector winding stem in an axial line direction, an hour hand corrector lever for disengaging the hammer from the operating cam based on operation of the hour hand corrector setting lever, an hour hand corrector clutch wheel for movement in the axial line direction of the hour corrector winding stem based on operation of the hour hand corrector setting lever and for undergoing rotation based on the rotation of the hour corrector winding stem, and a time correction transmitting wheel train portion for rotating the hour jumper pinion based on the rotation of the hour hand corrector clutch wheel.

8. A multi-functional timepiece according to claim 6; further comprising a time correction wheel train having a gear member; and wherein the hour hand corrector lever has a long hole integral with a stem portion of the gear member of the time correction wheel train.

9. A multi-functional timepiece according to claim 1 or claim 2; further comprising an hour wheel mounted for rotation at a first rotational speed, an hour hand wheel mounted for rotation at a second rotational speed egual to one-half the rotational speed of the hour wheel, and a 24 hour hand for displaying time in a 24 hour system based on the rotation of the hour hand wheel.

10. A multi-functional timepiece according to claim 1; further comprising:

a wheel train for a display of the timepiece, the wheel train having an hour wheel having a center hole and a plurality of band portions at an outer periphery thereof, a bush for rotatably supporting the band portions of the hour wheel, and a center wheel and pinion mounted for rotation without being brought into contact with the center hole of the hour wheel; and a wheel train for transmitting rotation in the timepiece, the wheel train having a first gear integrally mounted to a part of the timepiece for rotation therewith and having a guide pin and a rotational center, and a second gear integrally mounted to a part of the timepiece for rotation about a rotational center coaxial with the rotational center of the first gear, a portion of a bottom of the second gear being guided by the guide pin of the first gear.

11. A multi-functional timepiece according to claim 3; further comprising a day indicator driving wheel mounted for rotation based on the operation of the driving portion, a date driving wheel mounted for rotation based on the operation of the driving portion, day indicator driving wheel phase adjustment means provided to the day indicator driving wheel for adjusting phases of a day indicator driving wheel gear of the day indicator driving wheel and a date driving wheel gear of the date driving wheel, and date driving wheel phase adjustment means provided to the date driving wheel for adjusting the phases of the day indicator driving wheel gear and the date driving wheel gear.

12. A multi-functional timepiece according to claim 3; further comprising an hour wheel gear mounted for rotation based on the operation of the driving portion, an hour jumper pinion integral with the hour wheel gear for rotation therewith such that a phase of rotation between the hour jumper pinion and the hour wheel gear can be changed, an hour hand for displaying time information based on the rotation of the hour jumper pinion, a time correction transmitting portion for rotating the hour jumper pinion during a time correction operation, an hour hand corrector lever for disengaging the hammer from the operating cam during the time correction operation, and a display member for displaying a time correction state of the multi-functional timepiece set by the rotation of the day wheel based on the oscillating motion of the hammer.

13. A multi-functional timepiece according to claim 12; further comprising an hour corrector winding stem for performing a time correction operation, an hour hand corrector setting lever mounted for oscillation based on movement of the hour corrector winding stem in an axial line direction, an hour hand corrector lever for disengaging the hammer from the operating cam based on operation of the hour hand corrector setting lever, an hour hand corrector clutch wheel for movement in the axial line direction of the hour corrector winding stem based on operation of the hour hand corrector setting lever and for undergoing rotation based on the rotation of the hour corrector winding stem, and a time correction transmitting wheel train portion for rotating the hour jumper pinion based on the rotation of the hour hand corrector clutch wheel.

14. A multi-functional timepiece according to claim 3; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

15. A multi-functional timepiece according to claim 4; further comprising an hour wheel gear mounted for rotation based on the operation of the driving portion, an hour jumper pinion integral with the hour wheel gear for rotation therewith such that a phase of rotation between the hour jumper pinion and the hour wheel gear can be changed, an hour hand for displaying time information based on the rotation of the hour jumper pinion, a time correction transmitting portion for rotating the hour jumper pinion during a time correction operation, an hour hand corrector lever for disengaging the hammer from the operating cam during the time correction operation, and a display member for displaying a time correction state of the multi-functional timepiece set by the rotation of the day wheel based on the oscillating motion of the hammer.

16. A multi-functional timepiece according to claim 15; further comprising an hour corrector winding stem for performing a time correction operation, an hour hand corrector setting lever mounted for oscillation based on movement of the hour corrector winding stem in an axial line direction, an hour hand corrector lever for disengaging the hammer from the operating cam based on operation of the hour hand corrector setting lever, an hour hand corrector clutch wheel for movement in the axial line direction of the hour corrector winding stem based on operation of the hour hand corrector setting lever and for undergoing rotation based on the rotation of the hour corrector winding stem, and a time correction transmitting wheel train portion for rotating the hour jumper pinion based on the rotation of the hour hand corrector clutch wheel.

17. A multi-functional timepiece according to claim 5; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

18. A multi-functional timepiece according to claim 5; further comprising an hour wheel gear mounted for rotation based on the operation of the driving portion, an hour jumper pinion integral with the hour wheel gear for rotation therewith such that a phase of rotation between the hour jumper pinion and the hour wheel gear can be changed, an hour hand for displaying time information based on the rotation of the hour jumper pinion, a time correction transmitting portion for rotating the hour jumper pinion during a time correction operation, an hour hand corrector lever for disengaging the hammer from the operating cam during the time correction operation, and a display member for displaying a time correction state of the multi-functional timepiece set by the rotation of the day wheel based on the oscillating motion of the hammer.

19. A multi-functional timepiece according to claim 18; further comprising an hour corrector winding stem for performing a time correction operation, an hour hand corrector setting lever mounted for oscillation based on movement of the hour corrector winding stem in an axial line direction, an hour hand corrector lever for disengaging the hammer from the operating cam based on operation of the hour hand corrector setting lever, an hour hand corrector clutch wheel for movement in the axial line direction of the hour corrector winding stem based on operation of the hour hand corrector setting lever and for undergoing rotation based on the rotation of the hour corrector winding stem, and a time correction transmitting wheel train portion for rotating the hour jumper pinion based on the rotation of the hour hand corrector clutch wheel.

20. A multi-functional timepiece according to claim 5; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

21. A multi-functional timepiece according to claim 6; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

22. A multi-functional timepiece according to claim 7; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

23. A multi-functional timepiece according to claim 7; further comprising a time correction wheel train having a gear member; and wherein the hour hand corrector lever has a long hole integral with a stem portion of the gear member of the time correction wheel train.

24. A multi-functional timepiece according to claim 8; further comprising an hour wheel mounted for rotation at a first rotational speed, an hour hand wheel mounted for rotation at a second rotational speed equal to one-half the rotational speed of the hour wheel, and a 24 hour hand for displaying time in a 24 hour system based on the rotation of the hour hand wheel.

25. A multi-functional timepiece according to claim 1; wherein the display member is integrally connected to the day wheel for undergoing angular displacement therewith to display time or date information, the angular displacement of the display member being limited to an angular range of less than 360 degrees.

26. A multi-functional timepiece according to claim 25; further comprising a biasing member integrally connected to the day wheel for biasing the display member in one of the opposite directions.

27. A multi-functional timepiece according to claim 1; wherein the display member is integrally connected to the day wheel for undergoing angular displacement therewith in the opposite directions.

28. A multi-functional timepiece according to claim 27; further comprising a biasing member integrally connected to the day wheel for biasing the display member in one of the opposite directions.

29. A multi-functional timepiece comprising: a base; a wheel train mounted on the base for rotation; a cam member rotationally driven by the wheel train about a rotational center; a rotary member mounted to undergo angular displacement in opposite directions; a display member integrally connected to the rotary member for angular displacement therewith to display time or date information; and an interconnecting member for interconnecting the cam member to the rotary member such that rotational motion of the cam member effects angular displacement of the rotary member in the opposite directions.

30. A multi-functional timepiece according to claim 29; further comprising a biasing member integrally connected to the rotary member for biasing the display member in one of the opposite directions.

31. A multi-functional timepiece according to claim 29; wherein the angular displacement of the display member is limited to an angular range of less than 360 degrees.

32. A multi-functional timepiece according to claim 31; further comprising a biasing member integrally connected to the rotary member for biasing the display member in one of the opposite directions.

33. A multi-functional timepiece according to claim 29; wherein the cam member has an outer peripheral surface; and wherein the interconnecting member comprises an oscillating member for undergoing oscillating motion by being brought into contact with the outer peripheral surface of the cam member.

34. A multi-functional timepiece according to claim 29; wherein the cam member has a radius extending from the rotational center to the outer peripheral surface thereof and which varies continuously between a minimum value and a maximum value along the circumferential direction of the outer peripheral surface.

35. A multi-functional timepiece according to claim 34; wherein the cam member has an outer peripheral surface; and wherein the interconnecting member comprises an oscillating member for undergoing oscillating motion by being brought into contact with the outer peripheral surface of the cam member, the cam member being rotationally driven by the wheel train in a direction of substantially increasing a distance between the rotational center of the cam member to a point where the outer peripheral surface of the cam member is brought into contact with the oscillating member.

36. A multi-functional timepiece according to claim 35; further comprising a biasing member integrally connected to the rotary member for biasing the display member in one of the opposite directions.

37. A multi-functional timepiece according to claim 35; wherein the angular displacement of the display member is limited to an angular range of less than 360 degrees.

38. A multi-functional timepiece according to claim 37; further comprising a biasing member integrally connected to the rotary member for biasing the display member in one of the opposite directions.

* * * * *